US005448027A

United States Patent [19]

Hoffman et al.

[11] Patent Number: 5,448,027

[45] Date of Patent: Sep. 5, 1995

[54] SAFETY SWITCHED OUTLET WITH DEAD FRONT

[75] Inventors: Ernest G. Hoffman, Middlefield; William C. Boteler, Bridgeport; John J. Dennison, Southington, all of Conn.

[73] Assignee: Hubbell Incorporated, Orange, Conn.

[21] Appl. No.: 85,076

[22] Filed: Jul. 2, 1993

[51] Int. Cl.[6] ..... H01H 9/24

[52] U.S. Cl. ..... 200/50 B; 200/50 A

[58] Field of Search ..... 200/50 R, 50 A, 50 AA, 200/50 B, 50 C, 51, 51 R–51.17, 501, 318–327

[56] References Cited

U.S. PATENT DOCUMENTS

| | | | |
|---|---|---|---|
| 2,241,828 | 5/1941 | Reynolds | 200/50 |
| 3,735,078 | 5/1973 | Appleton et al. | 200/168 G |
| 4,506,121 | 3/1985 | Peterson | 200/50 B |
| 4,553,000 | 11/1985 | Appleton | 200/50 B |
| 4,604,505 | 8/1986 | Henninger | 200/50 B |
| 5,298,701 | 3/1994 | Sander | 200/50 B |

*Primary Examiner*—A. D. Pellinen
*Assistant Examiner*—Michael A. Friedhofer
*Attorney, Agent, or Firm*—Jerry M. Presson; Mark S. Bicks

[57] ABSTRACT

A switched outlet having a dead front includes a housing, an electrical receptacle mounted in the housing for receiving an electrical plug, a switch mounted in the housing, a handle coupled to the housing and movable between on and off positions, and a switch actuating mechanism. The switch actuating mechanism is coupled to the switch for activating and deactivating the switch. A clutch engages or disengages the handle and the switch activating mechanism. The clutch engages the handle and the switch actuating mechanism when an electrical plug is fully inserted in the electrical receptacle. The clutch disengages the handle from the switch actuating mechanism when no electrical plug is fully received in the electrical receptacle.

27 Claims, 12 Drawing Sheets

FIG. 5
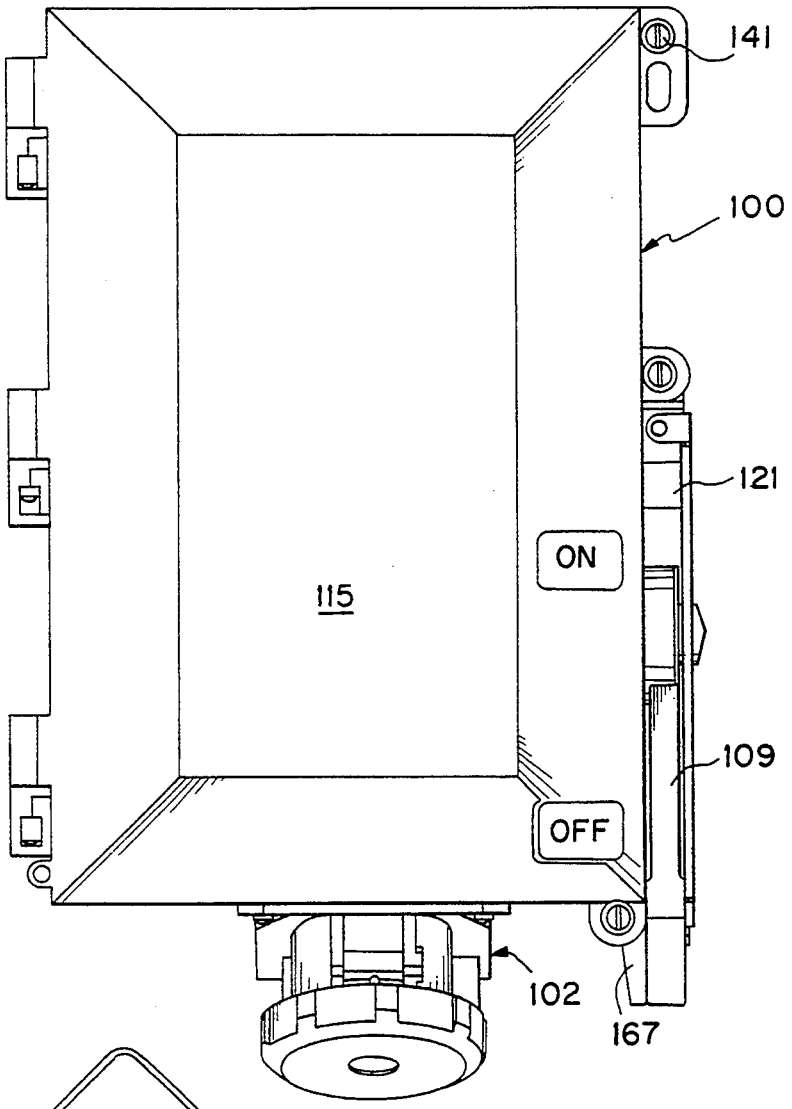
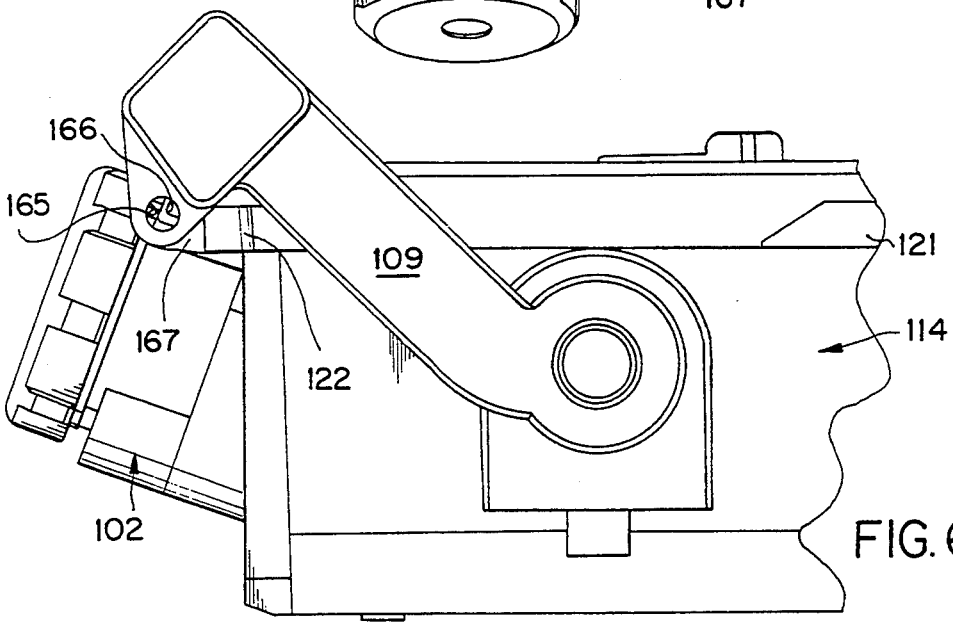
FIG. 6

FIG. 8
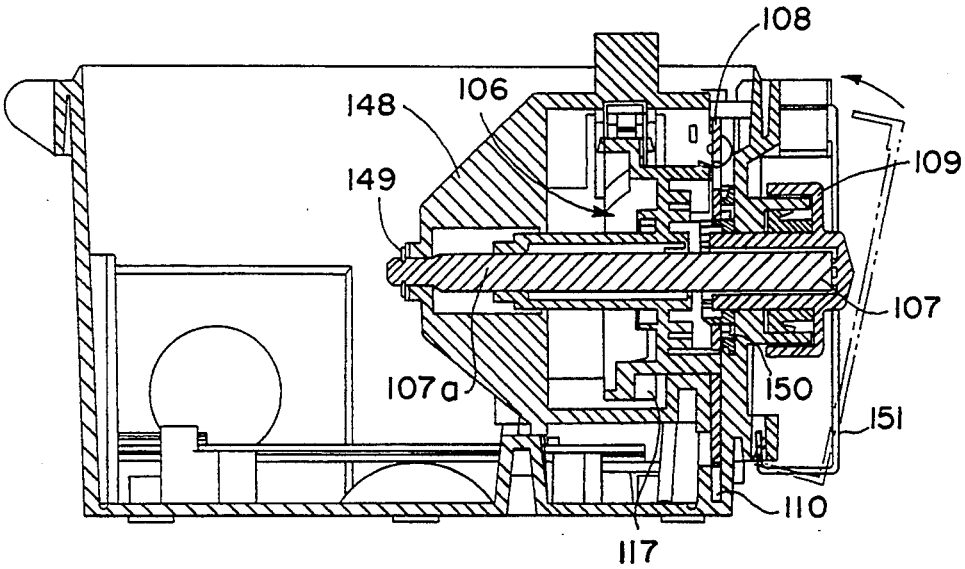
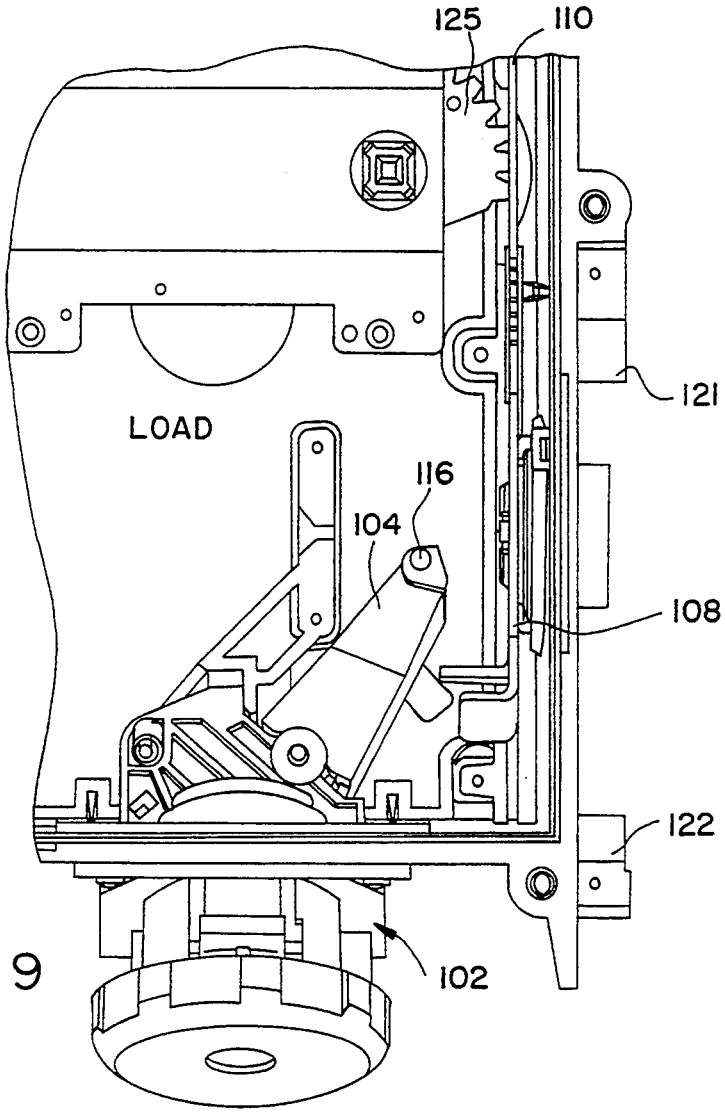
FIG. 9

FIG. 12
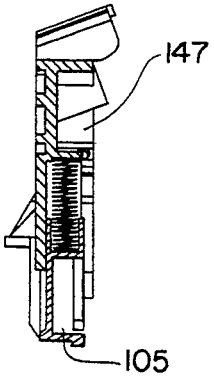
FIG. 13
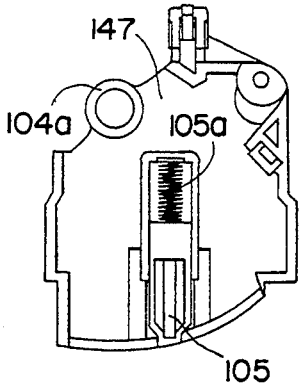
FIG. 14
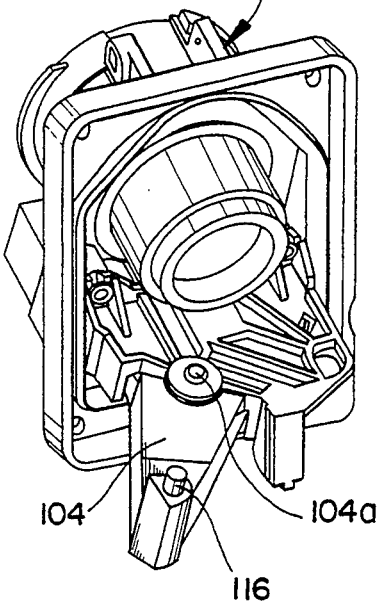
FIG. 15
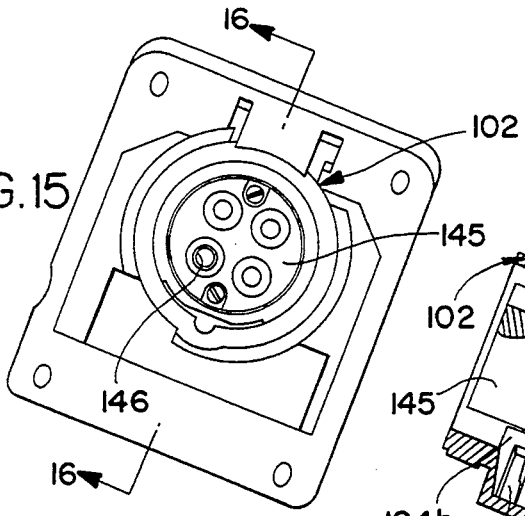
FIG. 16
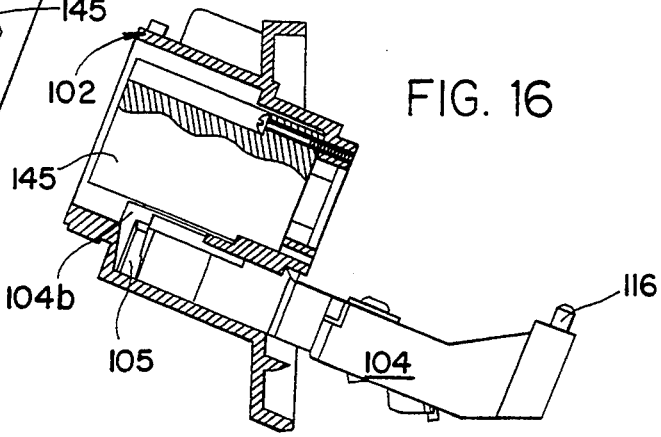
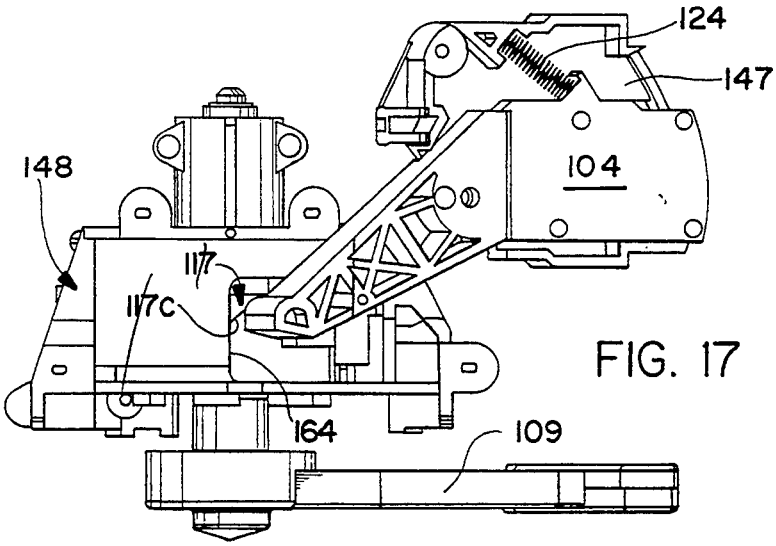
FIG. 17

FIG. 18
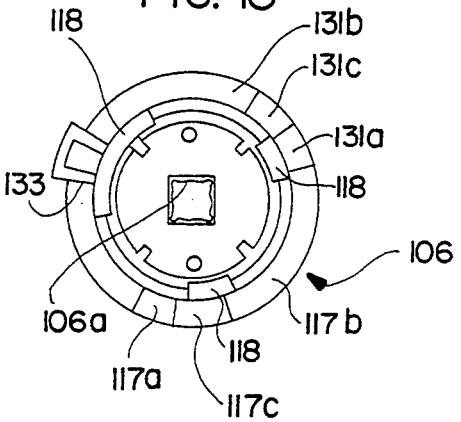
FIG. 19
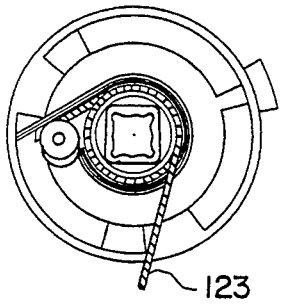
FIG. 20
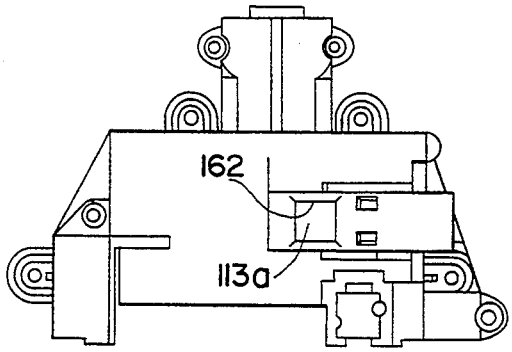
FIG. 21
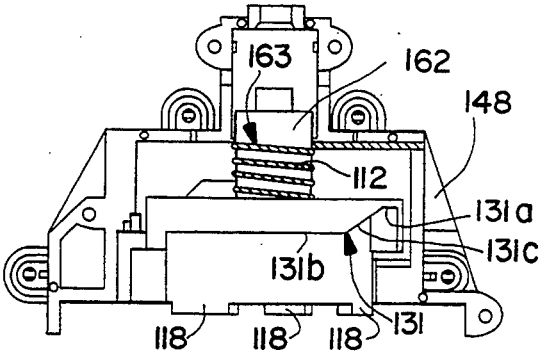
FIG. 22
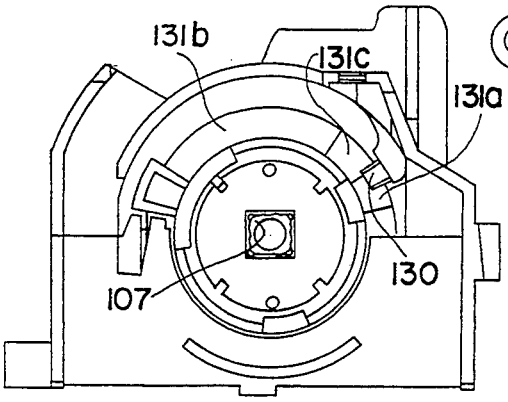
FIG. 23
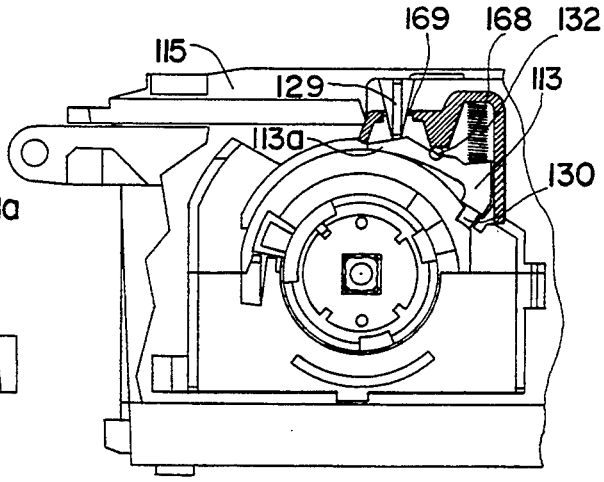
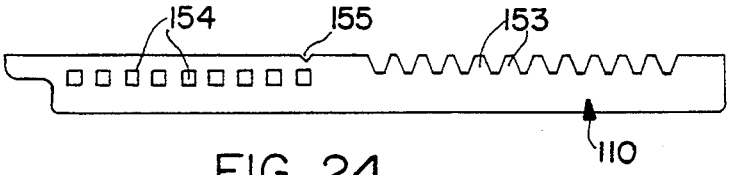
FIG. 24

300
310
322
ON
323
OFF
313
324
342
343
312
340
341
326
319
321
320
325
307
311
346
309
345
352
327
347
308
317
318
348
350
316
344
349
314
315
304b
304a
306a
304
305
302
306
303
301

354
355
353
356
351

FIG. 31
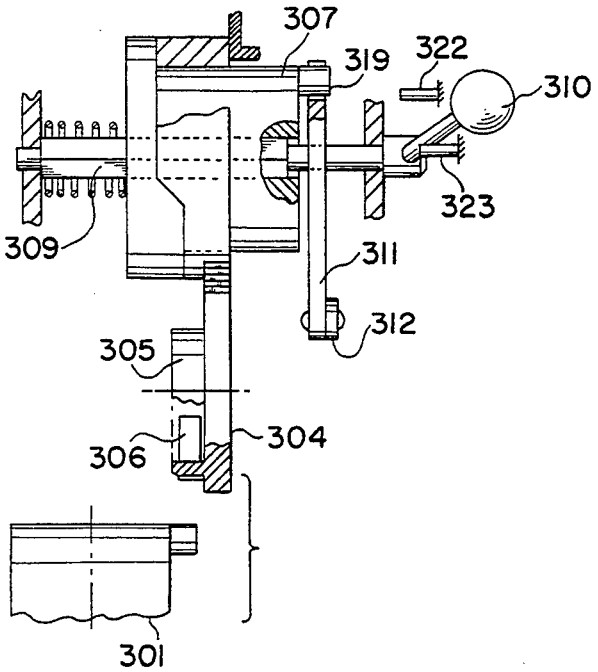
FIG. 32
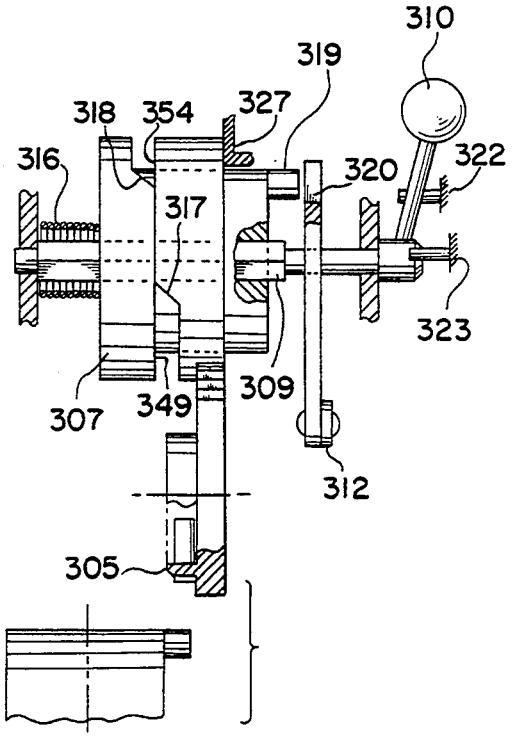
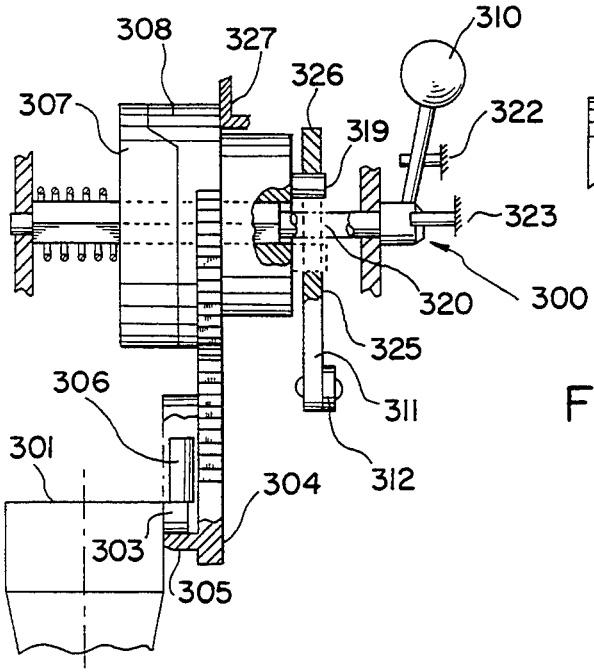
FIG. 33

SAFETY SWITCHED OUTLET WITH DEAD FRONT

FIELD OF THE INVENTION

The present invention relates to a switched outlet having an operating handle which moves from the off position to the on position even when no plug is received within the outlet. When a plug is not inserted into the outlet receptacle, the operating handle is effectively disengaged from the switch actuating mechanism by a clutch such that operation of the handle does not activate the switch and does not energize the outlet terminals. The clutch controls whether the operating handle movement moves or does not move the mechanical switch actuating mechanism to avoid excess force being applied to the mechanical switch actuating mechanism.

BACKGROUND OF THE INVENTION

Conventional safety switched outlets with dead fronts include a mechanical linkage interlocking the electrical receptacle and the switch. The linkage provided prevents the switch handle from being moved to an on position unless a plug is fully inserted in the electrical receptacle. Because the mechanical linkage prevents movement of the switch handle to the on position when no plug is in the receptacle, excessive force used in attempting to move the handle can break or bend the mechanical linkage, thereby damaging the outlet mechanism.

The disadvantage of these conventional mechanically interlocked systems is that users attempt to force movement of the handle to the on position, risking damaging the outlet mechanism. To avoid this problem, the outlet mechanism and components are usually made to be very strong to withstand the abuse. However, increasing the strength of the components is costly, makes the mechanism more difficult to operate, and is not always successful. Typical examples of conventional mechanically interlocked switched outlets which would cause linkage damage upon operation of the switch handle without a plug inserted in the receptacle are disclosed in U.S. Pat. No. 2,241,828 to Reynolds and U.S. Pat. No. 4,604,505 to Henninger.

U.S. Pat. No. 4,506,121 to Peterson discloses a mechanically interlocked switch outlet with a mechanism for preventing overloading of the switched linkage due to improper switch handle operation when a plug is not inserted in the receptacle. Such mechanism permits the handle to move from the off position to the on position without the plug being located within the electrical receptacle and without such handle movement actuating the switch or circuit breaker. In each of the several embodiments disclosed in the Peterson patent, a spring is provided in the mechanism which transmits force between the handle and the switch actuating mechanism. When the plug is inserted in the receptacle, the switch biasing force provides a force transmitting connection between the handle and the switch to actuate the switch. If no plug is received in the receptacle, the force transmission is impeded to an extent that will overcome the biasing force of the spring such that the handle moves to the on position without actuating the switch. However, the force override mechanism of the Peterson patent does not appear to be an effective solution to the problem of the conventional mechanically interlocked switched outlets.

SUMMARY OF THE INVENTION

One object of the present invention is to provide a safety switched outlet with a dead front which will not be damaged by movement of the operating handle from the off position to the on position without an electrical plug fully secured in the electrical receptacle.

Another object of the present invention is to provide a safety switched outlet with a dead front which is easy to manufacture, effective and simple to maintain and use and is highly reliable.

The foregoing objects are physically obtained by a switched outlet presenting a dead front comprising a housing, an electrical receptacle mounted in the housing for receiving an electrical plug, a switch mounted in the housing, a handle coupled to the housing and movable between on and off positions, and switch actuating means coupled to the switch for activating and deactivating the switch. Clutch means mounted in said housing engages the handle and the switch actuating means in a first position of the clutch means such that movement of the handle from the off position to the on position operates the switch through the switch actuating means. The clutch means disengages the handle and the switch actuating means in a second position of the clutch means such that movement of the handle from the off positon to the on position does not actuate the switch. Control means are coupled to the clutch means and the electrical receptacle for placing the clutch means in the first position when the electrical plug is fully inserted in the electrical receptacle and for placing the clutch means in the second position when no electrical plug is fully received in the electrical receptacle, during movement of the handle from the off position to the on position.

By forming the switched outlet in this manner, the operating handle can be moved from the off position to the on position even when no electrical plug is received in the electrical receptacle, without damaging any mechanism within the switched outlet. When the plug is not inserted in the electrical receptacle, the operating handle is effectively disengaged from the switch actuating mechanism by the clutch means such that operation of the handle to the on position does not activate the switch and does not energize the terminals. However, when a plug is received in the electrical receptacle, movement of the handle moves the switch actuating mechanism to activate the switch to its on condition thereby energizing the terminals of the receptacle.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 5 is top plan view of a switched outlet incorporating the operational characteristics of the first embodiment of the present invention with the door closed;

FIG. 6 is a partial, side elevational view of the switched outlet of FIG. 5;

FIG. 8 is a front elevational view in section taken along lines 8—8 of FIG. 7 with portions removed for illustration;

FIG. 9 is a partial top plan view of the switched outlet of FIG. 5, with portions of the structure removed;

FIG. 12 is a side elevational view in section of a latch cover for the switched outlet of FIG. 1;

FIG. 13 is a bottom plane view of the latch cover of FIG. 12;

FIG. 14 is a perspective view of the electrical receptacle of FIG. 5 viewed generally in a direction from inside the housing;

FIG. 15 is a front elevational view of the electrical receptacle for the switched outlet of FIG. 5;

FIG. 16 is a side elevational view in section taken along lines 16—16 of FIG. 15;

FIG. 17 is a bottom plan view of the operating handle, clutch and control mechanism of the switched outlet of FIG. 5;

FIGS. 18 and 19 are opposite side elevational views of the clutch member of the switched outlet of FIG. 5;

FIGS. 20 and 21 are top plan views with and without the upper part of the clutch housing, respectively, of the clutch of the switched outlet of FIG. 5;

FIGS. 22 and 23 are side elevational views of the clutch of the switched outlet of FIG. 5, with and without partial sections, respectively;

FIG. 24 is a side elevational view of the link rack of the switch actuating mechanism of the switched outlet of FIG. 5;

FIGS. 31—33 are side elevational views, partially in section, illustrating various operational positions of the switched outlet of FIG. 29.

DETAILED DESCRIPTION OF THE INVENTION

Figure 1:
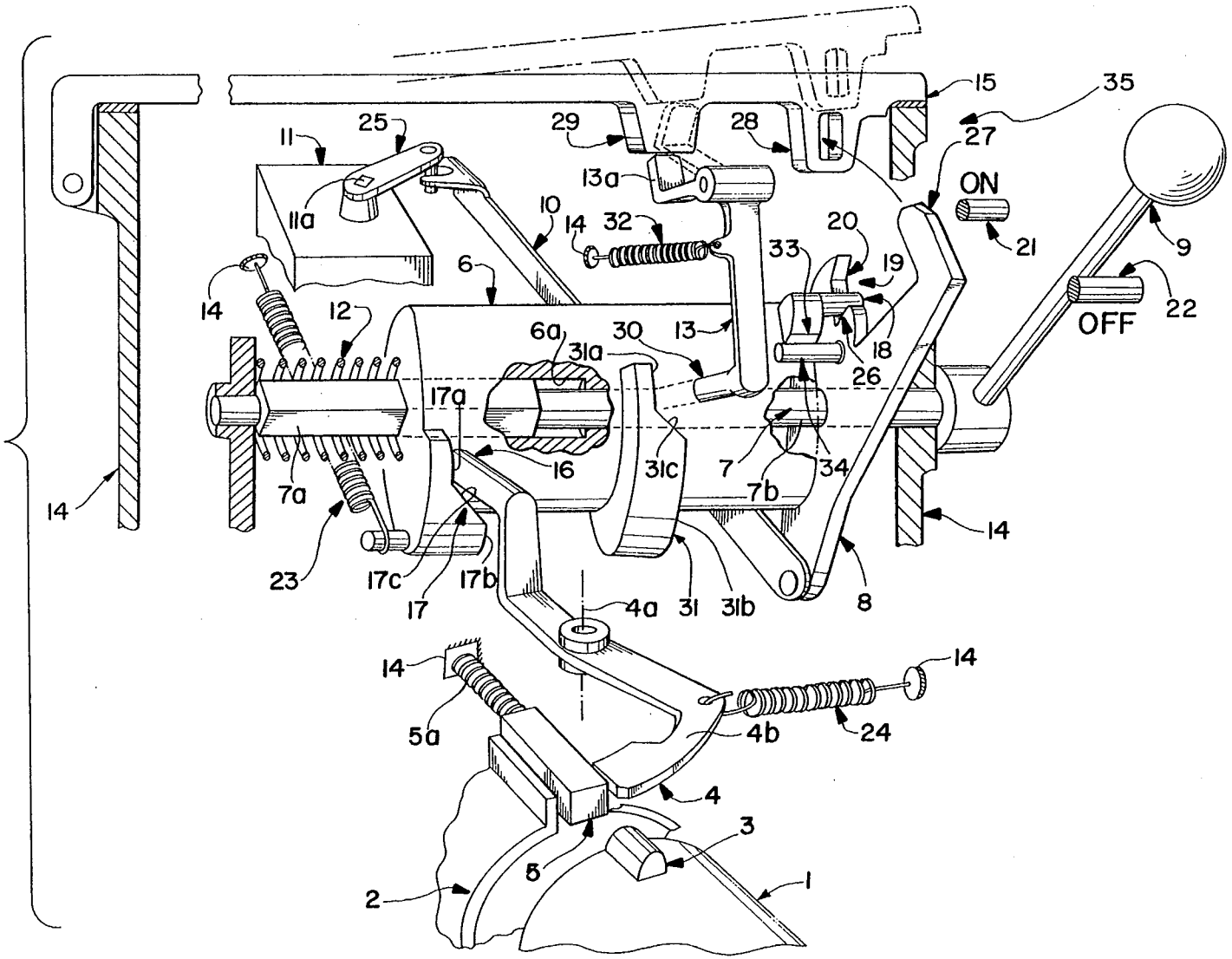
FIG. 1 is a perspective view graphically and diagrammatically illustrating a switched outlet according to a first embodiment of the present invention.

Referring initially to FIG. 1, the switched outlet 35 according to the first embodiment of the present amendment comprises a housing 14 having an electrical receptacle 2 mounted in one wall of the housing for receiving an electrical plug 1. A switch 11 is mounted in the housing for operation by operating handle 9. A clutch member or barrel 6 engages or disengages handle 9 from the mechanism for operating switch 11 depending on the position of clutch member 6. In a first position of the clutch member, movement of handle 9 from the off position to the on position operates switch 11 through the switch actuating mechanism. When the clutch member 6 is in a second position, handle 9 is disengaged from the switch actuating mechanism such that movement of the handle from the off position to the on position does not operate switch 11. The clutch member is controlled such that the clutch is in its first position when plug 1 is fully received in receptacle 2 and in the second position when the plug is not in the electrical receptacle, during movement of the handle from the off position to the on position.

Electrical plug 1 and electrical receptacle 2 can conform to the standards of IEC-309-2 or to other suitable plug and receptacle configurations. A plug nose or key 3 extends radially outwardly at the end of the plug shroud, and has predetermined axial length. A plug latch 4 is pivotally mounted in the housing for rotation about a pivot axis 4*a*. Adjacent receptacle 2, latch 4 has a latch arm 4*b* which will engage behind plug key 3 when the plug is fully inserted within the receptacle to retain the plug in the receptacle and to prevent its inadvertent removal when the switch is activated. The end of latch 4 opposite latch arm 4*b* comprises a cam follower 16 for engaging clutch barrel 6. A spring 24 is coupled to the housing and to latch 4 to bias the latch in the direction which causes cam follower 16 to be engaged with a cam track 17 on clutch barrel 6.

Receptacle 2 includes an axially slidable imposer 5 which is engaged by plug key 3. When the plug is removed from the receptacle, imposer 5 is engaged by the free end of latch arm 4*b* to maintain latch 4 in the position illustrated in FIG. 1. When the plug is inserted, key 3 pushes imposer 5 against the bias of spring 5*a* to retract the imposer and to allow latch 4 to pivot once the plug is fully inserted within the receptacle such that latch arm 4*b* will engage a rear surface of key 3.

Clutch barrel 6 is mounted on clutch or operating shaft 7 so as to permit relative axial movement of the clutch barrel and shaft, but to prevent relative rotation of the clutch barrel and shaft. Such connection is provided by the mating rectangular or noncircular bore 6*a* in clutch barrel 6 and shaft portion 7*a*. The opposite ends of the shaft are suitably journaled in the housing to permit shaft 7 to rotate relative to the housing about the longitudinal axis of the shaft.

A switch actuator plate 8 is pivotally mounted about a cylindrical portion 7*b* of shaft 8. Shaft 7 and actuator plate 8 are rotatable relative to each other when not engaged by clutch barrel 6.

Shaft 7 extends through an opening in housing 14 to the exterior of the housing. The exteriorly extending portion of shaft 7 is fixedly attached to handle 9 such that movement of handle 9 between on-stop 21 and off-stop 22 causes shaft 7 to rotate. Stops 21 and 22 are suitably attached to housing 14.

The longitudinal axis of shaft 7 defines the pivot or rotational axis for actuator plate 8. Although actuator plate 8 is pivotable or rotatable relative shaft 7, the actuator plate does not move axially relatively to shaft 7. Eccentrically mounted on the lower end of actuator plate 8 is a switch link 10. Switch link 10 can be pivotally coupled to actuator plate 8, or can be alternatively connected by a rack-and-pinion gear arrangement. The opposite end of link 10 is pivotally coupled to a switch plate 25 at one end of the switch plate. The opposite end of the switch plate is non-rotatably coupled to a switch actuator shaft 11*a*. In this manner, rotation of actuator plate 8 causes longitudinal or axial movement of link 10 causing switch plate 25 and thereby switch shaft 11*a* to rotate. Rotation of the shaft actuates or deactivates switch 11 to energize or de-energize the electrical terminals in electrical receptacle 2.

Clutch barrel 6 is coupled to and biased by springs 12 and 23. Spring 12 biases clutch barrel 6 in an axial direction toward actuator plate 8. Spring 23 tortiously biases clutch barrel 6, and thereby shaft 7 and handle 9, to bias handle 9 toward off-stop 22.

The axial end of clutch barrel 6, adjacent actuator plate 8, includes an axially extending dog or projection 18 and an axially extending cam barrel face 33. Projection 18 is shaped to engage a recess 19 in actuator plate 8, while cam barrel face 33 is positioned to engage an axially extending switch plate projection 34. Projection 18 only extends within recess 19 when clutch barrel 6 is in the first position illustrated in FIG. 1. When the clutch barrel operatively engages handle 9 to actuator plate 8, rotation of handle 9 from the off position to the on position will cause rotation of actuator plate 8, and subsequent activation of switch 11 through movement of switch link 10 and switch plate 25.

The recess end faces 20 and 26 defining the ends of arcuate recess 18 are spaced apart by a distance substantially greater than the width of projection 18, i.e., in a direction transverse to the rotational axis. The curvature of arcuate recess 18 is centered on the rotational axis of actuator plate 8. The different spacing of end faces 20 and 26 relative to the width of projection 18 provide a lost motion connection as will be explained in greater detail hereinafter. The engagement of barrel end face 33 with switch plate projection 34 only occurs when the handle is rotated from the on position to the off position. Face 33 engages projection 34 to cause movement of the actuator plate to its off position upon movement of the handle to the off position whether the clutch barrel is engaged or disengaged from actuator plate 8 (i.e., whether projection 18 is located in recess 19 or is axially removed therefrom).

Clutch barrel 6 includes a first cam track 17. Cam track 17 comprises a first cam surface 17*a*, a second cam surface 17*b* and a ramp surface 17*c* connecting surfaces 17*a* and 17*b*. Cam surfaces 17*a* and 17*b* are transverse to the longitudinal axis of clutch barrel 6 and shaft 7 and are spaced from each other along the axial length of the shaft and barrel.

Latch 4 is locked in the position illustrated in FIG. 1 by engagement of the latch with imposer 5 when no plug is in receptacle 2. Engagement of cam follower 16 on surface 17*a* locates projection 18 within actuator plate recess 19. Upon rotation of the handle, and therewith the clutch barrel, ramp follower 16 follows cam track 17 by engaging ramp surface 17*c* and then cam surface 17*b*. As cam follower 16 engages ramp surface 17*c* and moves along that surface toward cam surface 17*b*, clutch barrel 6 is moved to the left, as viewed in FIG. 1. When cam follower 16 is on surface 17*b*, clutch barrel 6 is moved to the left sufficiently to completely remove clutch barrel projection 18 from actuator plate recess 19, thereby disengaging the handle from the actuator plate during movement of the handle to the on position. In this manner, continued rotation of the handle toward the on position will not cause actuator plate 8 to rotate. The lost motion provided by the different widths of recess 19 and projection 18 allow the clutch barrel to rotate a sufficient degree about is rotational axis and to move axially to withdraw projection 18 from recess 19 before projection 18 engages recess end face 20 for rotating actuator plate 8 in a manner to turn switch 11 on. When plug 1 is located in receptacle 2, latch 4 can pivot against the bias of spring 24 such that the latch will pivot as cam follower 16 moves along on ramp surface 17*c* to cam surface 17*b* to move latch arm 4*b* behind plug key 3 to retain and prevent inadvertent removal of plug 1 from receptacle 2.

An interlock lever 13 is pivotally mounted in the housing as a safety device to prevent actuation of the switch unless door or cover 15 closes housing 14. Lever 13 has a cam follower 30 on one lever end which is positioned for engagement with a second cam track 31 on clutch barrels 6. Cam track 31 includes cam surfaces 31*a* and 31*b* which are transverse to the rotational axis of shaft 7 and clutch barrel 6 and are axially spaced along that rotational axis. Surfaces 31*a* and 31*b* are connected an angled surface 31*c*. When cam follower 30 is engaged with cam surface 31*a*, clutch barrel 6 is located in the position illustrated in FIG. 1 with projection 18 extending through actuator plate recess 19. As cam follower 30 moves along the cam surface 31*c* to cam surface 31*a* as the clutch barrel is rotated when handle 9 is moved from the off position to the on position, clutch barrel 6 will be forced to the left such that projection 18 will be removed completely from recess 19 when cam follower 30 engages on cam track 31 to disengage handle 9 and actuator plate 8. A spring 32 attached to interlock lever 13 and to the housing biases follower 30 into engagement with cam track 31. The opposite lever end 13*a* is positioned to engage a projection 29 extending inwardly from the inner surface of door 15.

When projection 29 engages lever end 13*a*, i.e., when the door is fully closed, lever 13 is pivoted to move cam follower 30 radially outwardly and out of engagement with cam track 31 such that rotation of the clutch barrel will not cause axial movement of the clutch barrel as a result of engagement of cam follower 30 with cam track 31. However, if door 15 is open, rotation of the handle will not cause activation of the switch due to the engagement of cam follower 30 with cam track 31. End 13*a* of lever 13 is made accessible by a tool to allow a skilled technician to operate the switch even with the door is opened for maintenance and repair of the switched outlet.

A latch flange 27 extends from the upper end of actuator plate 8, and is formed as an integral part of actuator plate 8. Door 15 is provided with an inwardly extending door catch 28 formed to mate with latch lange 27. Latch flange 27 engages catch 28 when actuator plate 8 is pivoted to activate switch 11. The engagement of flange 27 and catch 28 prevents door 15 from being inadvertently opened while switch 11 is activated, i.e., supplying electrical energy to the circuit including receptacle 2.

Figure 2:
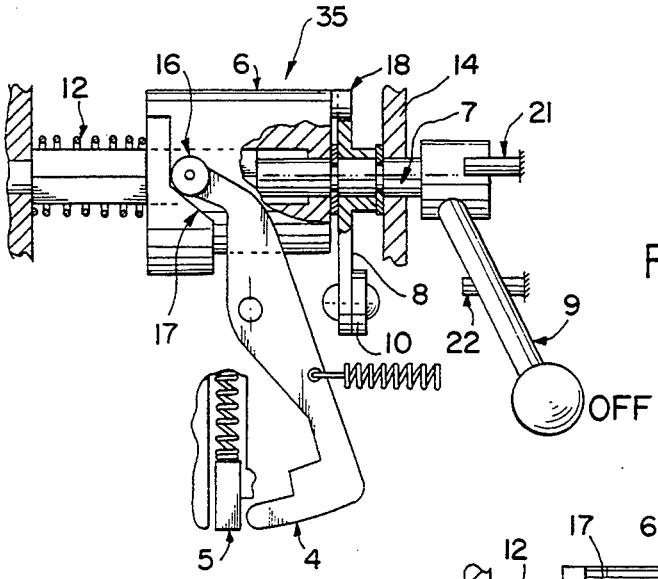
FIGS. 2–4 are side elevational views, partially in section diagrammatically and graphically illustrating the operation of the switched outlet of FIG. 1, with FIG. 2 showing the condition of the handle in the off position without a plug, FIG. 2 illustrating the condition of the handle in the on position without a plug and with the clutch disengaging the handle from the switch actuating mechanism, and FIG. 4 illustrating the handle in the on position with a plug fully inserted in the electrical receptacle and with the clutch engaging the handle with the switch actuating mechanism for activation of the switch.
Figure 3:
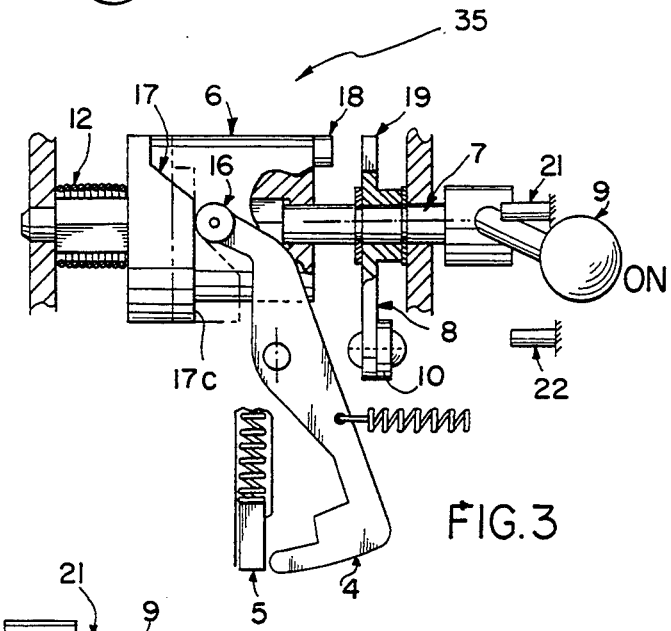
Figure 4:
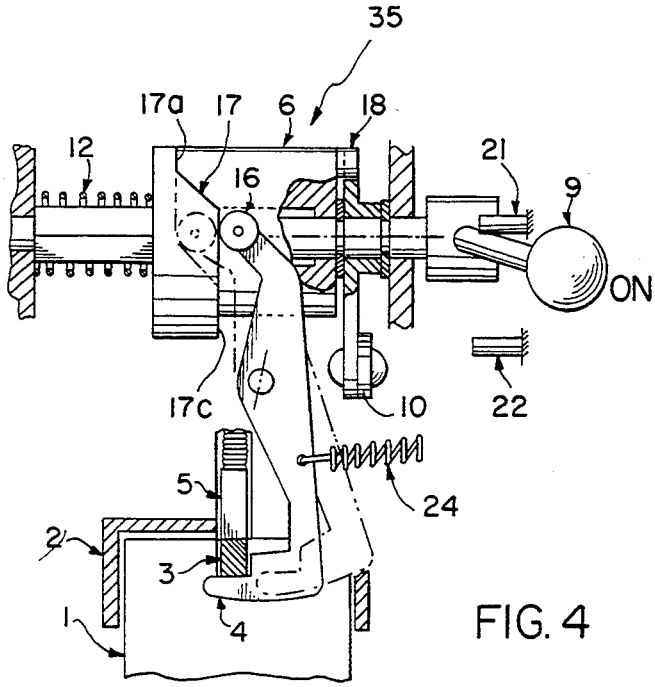

The operation of switched outlet 35 is described relative to FIGS. 2–4. The device is normally located with clutch barrel 6 engaged with actuator plate 8 by projection 18 extending into recess 19. Since the handle will normally be actuated with a plug inserted, and not without a plug inserted, less parts are necessary and less wear and tear is caused by the clutch barrel normally being engaged, i.e., clutch barrel 6 engaging actuator plate 8 to handle 9.

When no plug is inserted in receptacle 2, as graphically depicted in FIGS. 2 and 3, handle 9 can be moved from off-stop 22 to on-stop 21 without moving actuator plate 8 and thereby without activating switch 11. As handle 9 is rotated upwardly from off-stop 22 towards on-stop 21, clutch barrel 8 is rotated simultaneously by its connection throught shaft 7. Cam follower 16 is fixed in position and cannot be rotated due to the engagement of latch 4 with imposer 5. Rotation of clutch barrel 6 causes the clutch barrel to move axially to the left as the fixed or immovable cam follower 16 moves along cam track 17. Spring 12 is compressed as clutch barrel 6 moves to the left. Movement of the clutch barrel to the left causes projection 18 to be removed from recess 19, thereby disengaging handle 9 from actuator plate 8 when cam follower 16 is engaged on cam surface 17*b* as illustrated in FIG. 3. The relative sizes or widths of projection 18 and recess 19 are such that projection 18 will be completely removed from the actuator plate recess before projection 18 engages recess end surface 20, and thus, before any movement of actuator plate is caused. With clutch barrel 6 disengaged from actuator plate 8, movement of handle 9 will not actuate switch 11. Release of handle 9 allows the handle to return to engagement with the off-stop under the bias of return spring 23.

When plug 1 is inserted into receptacle 2, key 3 pushes imposer 5 back into the receptacle such that the imposer no longer impedes movement of latch 4. As handle 9 is rotated, causing clutch barrel 6 to rotate, cam follower 16 will again follow cam track 17. However, in this case, the cam follower will move along with latch 4 such that the latch rotates in a clockwise direction against the bias of return spring 24 as viewed in FIG. 4. The biasing force provided by return spring 24 is substantially less than that of return spring 12 to cause the latch 24 to move rather than clutch barrel 6.

As clutch barrel 6 is rotated, latch arm 4*a* will engage behind plug key 3 when cam follower 16 is engaged upon cam surface 17*c* as depicted in full lines in FIG. 4. In this manner, the plug is locked within the receptacle and cannot be withdrawn with handle 9 removed from off-stop 22. Continued rotation of handle 9 toward on-stop 21 causes projection 18 to engage recess end face 20 of actuator plate 8. At this point continued rotation of handle 9 is transmitted to actuator plate 8 causing axial movement of link 10, pivoting of switch plate 25 and rotation of switch shaft 11*a* resulting in activation of switch 11. The motion of handle 9 is stopped by on-stop 21 after a substantially 90° rotation. When the handle is released, return spring 23 causes clutch barrel 6 to rotate in the opposite direction until projection 18 engages recess end face 26 of recess 19. The actuator plate will not be rotated in a matter which would deactivate the switch since return spring 23 is substantially weaker than the over center switch spring in switch 11.

The switch is deactivated by moving the handle back against off-stop 22. This handle movement places cam follower 16 against cam surface 17*a*, allowing latch 4 to pivot back to its release position under the bias of spring 24 and releasing the plug for removal from the receptacle.

The activation of the switch assumed that door 15 is closed such that projection 29 engages lever 13 to remove cam follower 30 from cam track 31. If cam follower 30 is not removed from cam track 31, since the door 15 is open, the engagement of cam follower 30 and cam track 31 will prevent activation of the switch by disengaging the clutch upon movement of handle 9, even if a plug is located within receptacle 2, as described above.

Regardless of the axial positioning of the clutch barrel, the switch will always be deactivated by movement of the handle against off-stop 22 by the engagement of cam barrel face 33 with actuator plate projection 34. This provides an additional safety feature against a deliberate attempt made to bypass the interlock. The mechanism arrangement will always deactivate the switch when the handle is moved against off-stop 22.

FIGS. 5–24 illustrate a switched outlet 100 incorporating the operational concepts of the first embodiment of the invention illustrated in FIGS. 1–4. Structural parts in FIGS. 5–24 are identified with a reference numeral which is 100 greater than the reference numeral used to identify the corresponding part in FIGS. 1–4.

Figure 7:
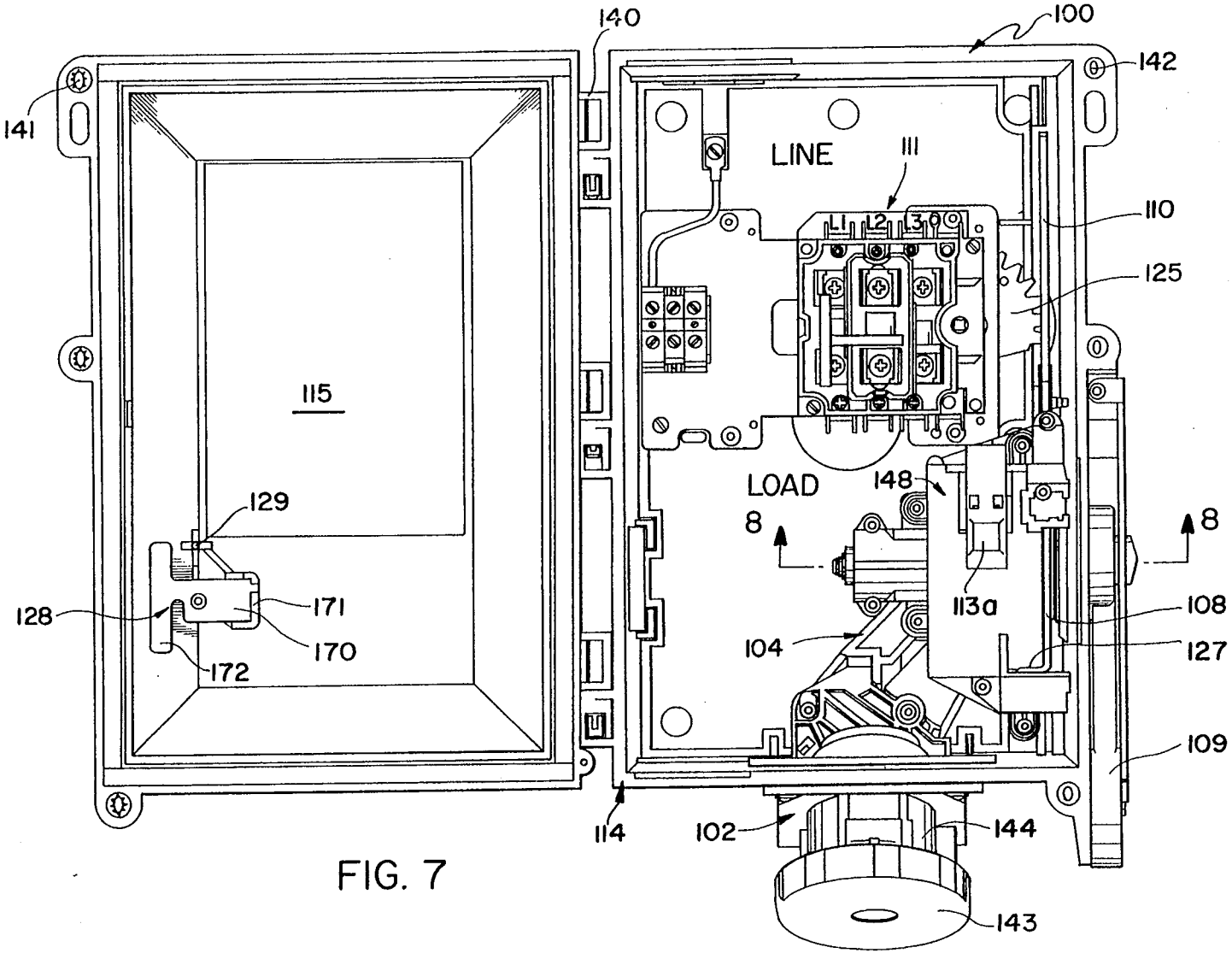
FIG. 7 is a top plan view of the switched outlet of FIG. 5, with the door in an open position.

Switched outlet 100, as illustrated in FIGS. 5–7, comprises a housing 114 in the form of a rectangular parallelepiped. A door 115 is coupled to housing 114 by a conventional hinge 140 to permit the door to pivot between the closed position of FIG. 5 and the open position of FIG. 7. Stud fastener assemblies 141 are mounted in the cover and are received within and are engaged within openings 142 in housing 114 to lock the door in its closed position.

Electrical receptacle 102 is mounted in a front wall of the housing. The opening of receptacle 102 can be opened and closed by a screw-on cover 143 which is coupled to receptacle 102 by hinge assembly 144 as illustrated in FIGS. 15 and 16. Receptacle 102 comprises a terminal block 145 in which a plurality of receptacles terminals 146 are housed.

Latch 104 is pivotally coupled to a cover 147 at pivot 104*a* to form a latch assembly (FIGS. 12–17). Cover 147 houses a slidably mounted imposer 105 and a spring 105*a* biasing the imposer toward a forward position. In the extended position of the imposer illustrated in FIGS. 12 and 13, imposer 105 engages an adjacent end of latch 104 to prevent latch 104 from pivoting. When imposer 105 is retracted within the cover 147 by engagement with a plug key, latch 104 will be freed to pivot against the bias of spring 124 such that flange or arm 104*b* of the latch can move behind the key to lock a plug in receptacle 102.

Clutch barrel 106 is mounted in a clutch housing 148. Clutch housing 148 is fixed within housing 114 by fasteners, such as screws. Clutch shaft 107 is rotatably mounted within clutch housing 148 and is secured against axial movement by an E-ring 149 (FIG. 8). The end of shaft 107 adjacent ring 149 is cylindrical to provide a journaled or rotatable connection for the shaft. The remainder of the shaft is rectangular in transverse cross-section to provide a nonrotable connection with clutch barrel 106, while permiting relative axially sliding movement between the shaft and the clutch barrel.

Actuator plate or gear 108 is rotatably mounted on a wall of housing 114 by a bushing 150. Bushing 150 extends through concentric openings in the housing side wall and in the center actuator gear 108, thereby rotatably mounting actuator gear 108 in the housing.

Shaft 107 extends through bushing 150 and is attached to handle 109 such that shaft 107 and handle 109 will rotate simultaneously. The end of handle 109 adjacent shaft 107 is covered and protected by handle guard 151. Handle guard 159 is attached to the outer surface of housing 114.

Below actuator gear 108, an elongated link or rack 110 is mounted within housing 114 for sliding movement along the longitudinal axis of rack 110. A suitable channel 152 is provided in the housing for supporting and guiding rack 110.

Figure 10:
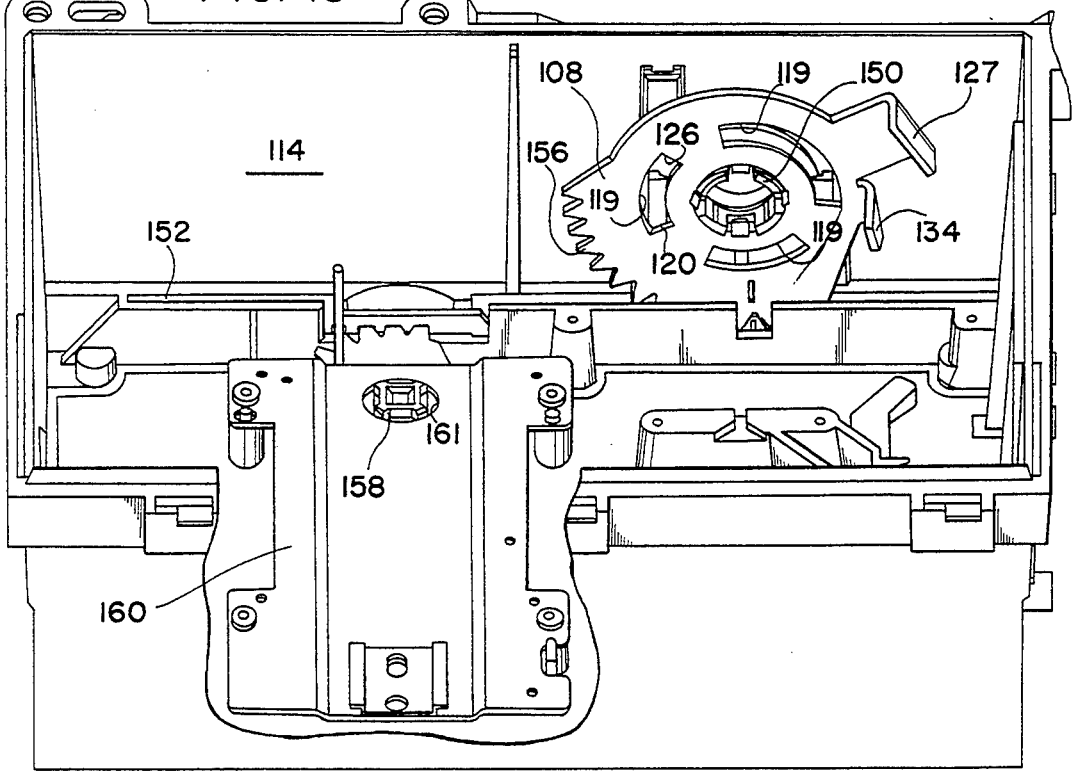
FIGS. 10 and 11 are partial, perspective views of the switched outlet of FIG. 5, with various portions removed for illustration purposes.

As best illustrated in FIG. 24, rack 110 comprises a plurality of upwardly extending gear teeth 153 adjacent one end of rack 110. Adjacent its opposite end, rack 110 has a series of axially aligned openings forming another set of gear teeth 154. A timing notch 155 is also provided on the rack. When the rack is installed in the housing, the gear teeth 156 of actuator gear 108 engage gear teeth 153 of rack 110. Rotation of actuator gear 108 in a counter-clockwise direction, as illustrated in FIG. 10 causes rack 110 to slide to the right. Rotation of actuator gear 108 in a clockwise direction causes rack 110 to slide to the left.

The openings of rack 110 forming its gear teeth 154 receive and engage the gear teeth 157 extending from switch plate or gear 125. Longitudinal sliding of rack 110 causes switch gear 125 to rotate in either direction depending on the direction of the longitudinal sliding of rack 110.

Figure 11:
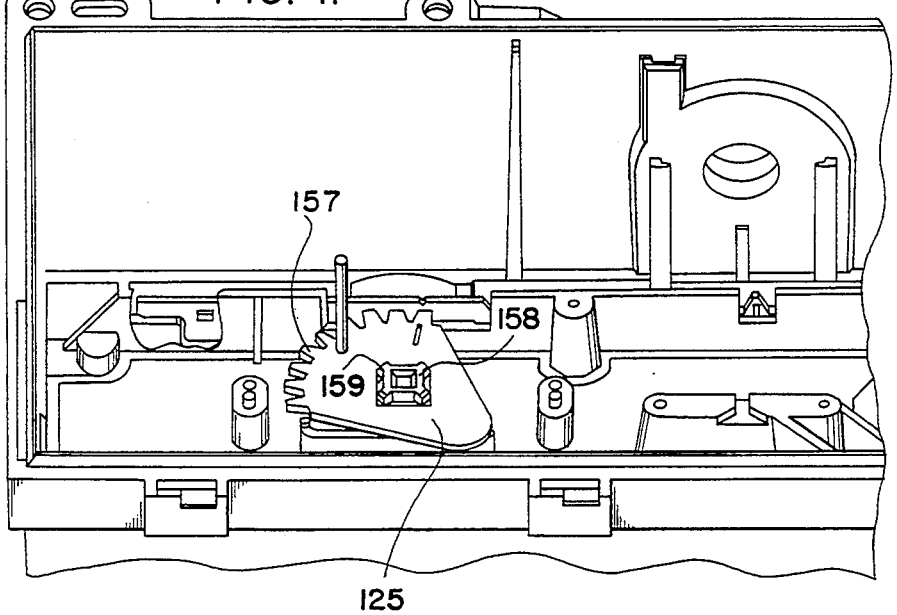
Figure 25:
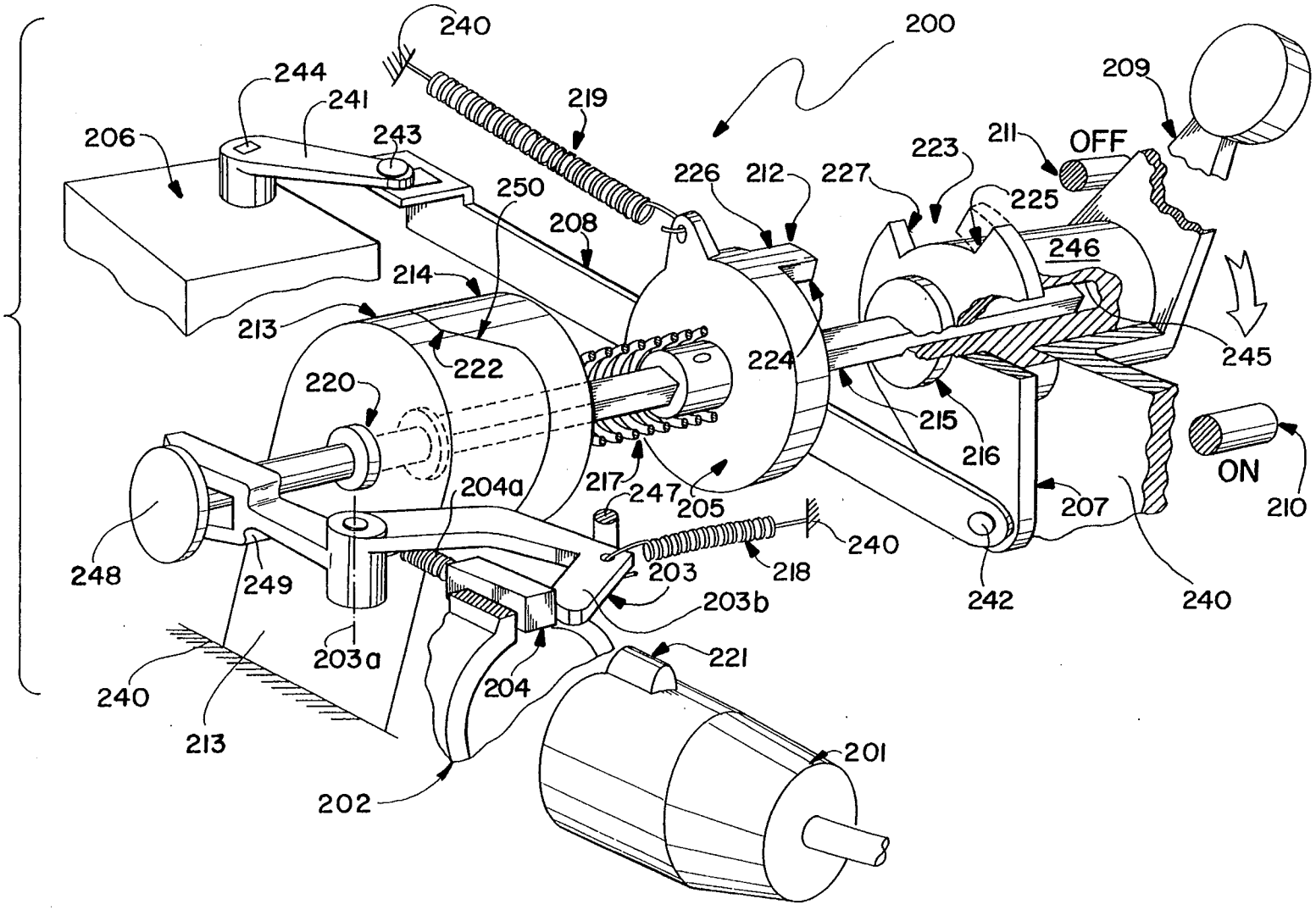
FIG. 25 is a perspective view graphically and diagrammatically illustrating a switched outlet according to a second embodiment of the present invention.

A rectangular bushing 158 is nonrotatably mounted in a rectangular opening 159 in switch gear 125, as illustrated in FIG. 11. Above the switch gear, a switch mounting plate 160 is secured in the housing, as illustrated in FIG. 10. The switch mounting plate has an opening 161 through which bushing 158 extends. Fused switch 111 is then secured to mounting plate 160 with the depending shaft of the switch mating with and received within bushing 158. Rotation of the switch plate in a counter-clockwise direction as illustrated in FIG. 7, activates or turns the switch on, while counter-clockwise rotation of switch gear 125 deactivates or turns the switch 111 off. The activation and deactivation of the switch is controlled by rotation of actuator gear 108.

Actuator gear 108 is rotated by handle 109 when engaged by clutch barrel 106. The end of clutch barrel 106 adjacent actuator gear 108 has a plurality of axially extending, circumferentially spaced, arcuate projections 119. These projections correspond in location, size and shape to arcuate, axially extending and circumferentially spaced recesses 120 in actuator gear 108. The arcuate extent of each projection 109 is less than the arcuate length of the mating recess to allow a degree of lost motion, i.e., rotation of the clutch barrel without causing rotation of the actuator gear even when the projections are located within the actuator gear recesses. The curvature of projections 119 and recesses 120 is centered on the rotational axis of clutch barrel 106 and actuator gear 108, respectively. Rotation of the clutch barrel will not rotate the actuator gear until the projections engage and push upon the recess end faces 120 and 126. The projections push upon recess end faces 120 to activate the switch. The projections engage and push on end faces 126 to deactivate the switch.

The rear portion of clutch barrel 106 comprises a cylindrical portion 162 (FIGS. 19 and 21). A spring 163 is mounted about cylindrical portion 162. The body 112 of the spring 163 acts as a compression spring while the ends 123 of spring 163 act as a torsional spring. In this manner, spring 163 acts as a compression spring to bias the clutch barrel 106 in an axial direction toward actuator gear 108, and as a torsional spring to rotate the clutch barrel and the handle toward the off position.

Clutch barrel 1 comprises a lower cam track 117 which is engaged by cam follower 116 (FIGS. 17–18). The lower cam track comprises two cam surfaces 117*a* and 117*b* which extend in planes traverse to the rotational axis of clutch member 106 are axially spaced from one another along that rotational axis. The two cam surfaces 117*a* and 117*b* are connected by a ramp surface 117c. When cam follower 116 is engaged on surface 117*a*, clutch member projections 118 are engaged within actuator plate recesses 119. When clutch member 106 is rotated by movement of handle 109 to the on position from the off position without a plug being inserted within receptacle 102, the fixed or immovable cam follower 116 causes clutch member 106 to move axially away from actuator plate 108 as the cam follower moves up ramp surface 117*c* and engages cam surface 117*b*, in which position the clutch member projections 119 are fully withdrawn from the actuator plate recesses 119.

When a plug is inserted within receptacle 102, latch member 104 can pivot such that movement of cam track 117 relative to cam follower 116 cause latch 104 to pivot from a plug receiving position when the cam follower engages cam surface 117*a* to a position in which latch 104 locks the plug within the receptacle when cam follower 116 is engaged with cam surface 117*b*.

To engage cam track 117, cam follower 116 extends through an opening 164 in the lower portion of clutch housing 148, as illustrated in FIG. 17.

Handle 109 is pivotable between on-stop 121 and off-stop 122. Stops 121 and 122 can be formed as integral projections extending laterally outwardly from housing 114 as illustrated in FIGS. 6 and 9. In this matter, the stops limit the angle of pivoting motion of the handle.

Handle 109 comprises an opening 165 (see FIG. 6) at its end remote from shaft 107. In the off position of the handle, illustrated in FIG. 6, opening 165 is aligned with an opening 166 in a flange 167 extending from housing 114. When opening 165 and 166 are aligned in the off position of handle 109, the hasp of a lock can be inserted and retained within those openings to lock the handle, and thereby the switch, in its off position.

A lever 113 is attached by a pivot mounting 168 within clutch housing 148, as illustrated in FIGS. 22 and 23. Pivot mounting 168 is located intermediate the ends of lever 113. Cam follower 130 extends inwardly from one end of the lever. The opposite end 113*a* of lever 113 is aligned with an opening 169 within the clutch housing. Opening 169 and lever end 113*a* are aligned with a projection 129 extending inwardly from the inner surface of cover 115. A spring 132 mounted in the clutch housing engages the end of the lever adjacent to cam follower 130 tending to bias a lever to pivot in a clockwise direction, as viewed in FIG. 23, and to bias cam follower 130 toward and into engagement with clutch member 106.

Clutch member 106 comprises an upper cam track 131. Cam track 131 includes surfaces 131*a* and 131*b* which are transverse to the rotational axis of the clutch member and are spaced from each other along the axial direction of the clutch member. The surfaces 131*a* and 131*b* are connected by an angled surface 131*c* (see FIG. 21). Lever 113 and cam track 131 provide a safety mechanism preventing activation of the switch when the cover is open. In FIG. 23, the cover is illustrated as being closed. In this closed position, cover projection 129 engages lever end 113*a*, pivoting lever 113 in a counter-clockwise direction to position cam follower 130 such that cam follower is disengaged from cam track 131. In this disengaged position, rotation of clutch member 106 is not effected by the lever.

FIG. 22 illustrates the lever engaged with cam track 131 when the cover is open. Spring 132 biases cam follower 130 into engagement with cam track 131. With cam follower engaged with cam surface 131*a*, clutch member projections 118 are received within actuator plate recesses 119. However, if handle 109 is pivoted towards its on position from the off position, clutch member 106 will rotate such that cam track 131 will move relative to cam follower 130 and cam follower 130 will move along angled surface 131*c* to cam surface 131*b*. As cam follower 130 moves along angled surface 131*c*, clutch member 106 is pushed in an axial direction away from actuator plate 108 (upwardly in FIG. 21, and into the plane of the paper in FIGS. 22 and 23) such that the projections 118 will be disengaged from the recesses 119 upon cam follower 130 engaging cam surface 131*b*. The configuration of cam track 131 relative to the sizes of projections 118 and recesses 119 are such to remove the projections from the recesses before projections 118 can engage recess end faces 120. Upon rotation of the handle back to its off position by forced movement of the handle or upon release of the handle under the bias of spring 163, spring portion 112 will push clutch member 106 axially back into engagement with actuator plate 108.

The switch can be operated with the door in its open position by inserting a tool within opening 169, thereby simulating closing of the door. Thus, lever 113 will not prevent operation of the switch to perform maintenance on the switched outlet, but will prevent inadvertent actuation of the switch when the door is open.

Actuator plate 108 includes a radially and axially extending flange 127. Flange 127 is formed as an integral and fixed part of actuator plate 108. Latch flange 127 engages a door catch 128 when the door is closed and actuator plate 108 is rotated to activate switch 111, to act as a safety mechanism preventing inadvertent opening of the door when the switch is activated.

Door catch 28 comprises a base member 170 secured to a mounting structure 171 formed on the inner surface of door 115. The mounting structure prevents door catch 128 from moving relative to door 115. A tang 172 of the door catch is bent out of the plane of the remaining portion of the door catch and forms an acute angle relative to the remainder of the door catch. When actuator plate 108 is rotated to turn the switch on, flange 127 rotates to a position between door 115 and tang 172. The engagement of tang 172 and flange 127 prevents the door from opening when the switch is on.

Switched outlet 100 is structured such that movement of the switch handle from the on position to the off position will always deactivate the switch, if the switch is in an on position, whether the clutch member 106 is engaged or disengaged from actuator plate 108. This further safety feature is provided by forming a cam face 133 on clutch member 106 (see FIG. 18) and an axially extending actuator plate projection 134 on actuator plate 108 (see FIG. 10). Projection 134 extends axially parallel to, but spaced from, the axis of rotation of actuator plate 108. Similarly, cam barrel face 133 extends in an axial direction which is parallel to and radially spaced from the axis of rotation of clutch member 108. The axial length of projection 134 is greater than the distance of the axial movement of the clutch member 106 such that cam face 133 will engage projection 134 in both the engaged and disengaged positions of the clutch member. If the switch is in its on position, rotation of the handle from the on position to the off position will cause clutch barrel face 134 to engage actuator plate projection 134 and to rotate actuator plate 106 in a clockwise direction, as viewed in FIG. 10 to move the switch actuator mechanism in a matter that will turn the switch to a deactivated or off condition.

The second embodiment of the present invention is diagrammatically and graphically illustrated in FIGS. 25–28. The switched outlet 200 of the second embodiment comprises a housing 240 having an electrical receptacle 202 mounted in one wall of the housing for receiving an electrical plug 201. A switch 206 is mounted in the housing for operation by handle 209. A clutch plate or member 205 engages or disengages handle 209 from the mechanism operating switch 206 depending on the position of clutch member 205. When clutch member 205 is in a first position, handle movement operates switch 206 through the switch actuating mechanism. In the second position of clutch member 205, handle 209 is effectively disengaged from and moves independently of the switch actuating mechanism such that movement of the handle towards its on position does not operate the switch. The clutch member is controlled such that the clutch in its first position when a plug is received in receptacle 202 and in its second position when the plug is not in the electrical receptacle, during handle movement to the on position.

Electrical plug and electrical receptacle 202 are similar to those of the first embodiment. A plug nose or key 221 extends radially outwardly at the end of the plug shroud and has a predetermined axial length. A plug latch 203 is pivotally mounted in the housing for rotation about a pivot axis 203*a* adjacent receptacle 202. Latch 203 has a latch arm 203*b* which will engage behind plug key 3 when the plug is fully inserted within the receptacle to retain the plug in the receptacle and to prevent inadvertent removal of the plug from the receptacle.

Receptacle 202 includes an axially slidable imposer 204 which is engaged by a plug key 221 and biased forwardly by spring 204*a*. When the plug is removed from the receptacle, imposer 204 is located in a position to be engaged by the free end of latch arm 203*b* to maintain latch 203 in the position illustrated in FIG. 25. When the plug is inserted, the plug key 221 pushes imposer 204 against the bias of spring 204*a* to retract the imposer and to allow latch 203 to pivot, against the bias of spring 218, once the plug is fully inserted within the receptacle such that the latch arm 203*b* will engage the rear surface of key 3.

Latch 203 is biased by a return spring 218 against a fixed stop 247 of the housing. Spring 218 is coupled to the latch 203 adjacent latch arm 203*b*.

The switch operating mechanism comprises an actuator plate 207, a switch link 208 and a switch plate 241. Switch actuator plate 207 is rotatably mounted in housing 240 on a bushing 216. Bushing 216 is mounted on clutch shaft 215 such that the shaft can slide axially relative to the bushing and the actuator plate. By means of bushing 216, actuator plate 207 rotates or pivots relative to the shaft about the longitudinal axis of the shaft.

Link 208 is pivotally coupled to actuator plate 207 for pivoting about an axis parallel the actuator plate axis of rotation, but eccentrically mounted or spaced from the actuator plate rotational axis, by a pivot pin 242 at one end of link 208. The opposite end of the link is pivotally coupled by a sliding pivot assembly 243 to one end of switch plate 241. The other end of the switch plate is nonrotatably coupled to the actuator shaft 244 of switch 206 to permit simultaneous rotation thereof. Rotation of actuator plate 207, in a generally clockwise direction as viewed in FIG. 25, causes link 208 to move longitudinal to the left. Such movement of the link causes rotation of the switch plate 241 about the longitudinal axis of switch actuator shaft 244 to move switch 206 to its on position. Rotation of actuator plate 207 in a counterclockwise direction moves link 208 to the right causing a reverse rotation of switch plate 224 and a reverse rotation of actuator shaft 214 to deactivate or turn switch 206 off.

Actuator plate 207 comprises an arcuate recess 223 having end faces 224 and 225. The arc of recess 223 is centered on the axis of rotation of actuator plate 204 but is spaced therefrom. End faces 225 and 227 of recess 223 define the width of the recess between them.

Movement of handle 209 relative to the housing is limited by on-stop 210 and off-stop 211. Stops 210 and 211 are fixed to the housing and define the on and off positions for the handle, respectively. Handle 209 is mounted in an opening in the wall of housing 240 to permit it to pivot between its on and off positions about the longitudinal axis of shaft 215. A bore 245 extends into a base portion 246 of the handle. The bore is a non-circular or rectangular transverse cross-sectional configuration that mates with the non-circular or rectangular transverse cross-sectional shape of shaft 115. Shaft 115 can slide axially within bore 145, but cannot rotate therein such that the clutch shaft and the handle are connected for simultaneous rotation.

Clutch plate 205 is fixed on clutch shaft 215 such that the clutch plate cannot move axially or rotationally relative to the clutch shaft. A projection protrudes axially from a surface of clutch plate 205 facing actuator plate 207 at a location radially spaced from shaft 215. Projection 212 extends axially parallel to shaft 215. The lateral sides of projection 212 are defined by projection faces 224 and 225. The spacing between projection faces 224 and 226 is substantially less than the spacing between recess end faces 225 and 227. A return spring 219 is eccentrically coupled to clutch plate 205 and to the housing to bias the clutch plate, and thereby shaft 215 and handle 209, toward the off position wherein handle 209 abuts off-stop 211.

When clutch plate 225 is moved axially, the clutch plate engages actuator plate 207 by projection 212 entering recess 223. Engagement of projection 212 in recess 223 engages actuator plate 207 to transmit the rotation of handle 209 to switch actuator plate 207 such that movement of the handle actuates or deactivates the switch. Movement of the actuator plate to activate the switch occurs when projection face 224 engages recess end face 225. Movement of the handle from the on position to the off position rotates actuator plate 207 when projection face 226 engages recess end face 227. When projection 212 is removed from recess 223, clutch plate 205 is deactivated so as to disengage the handle from the switch actuator plate 207.

The end of latch 203, opposite latch arm **203*b* is pivotally coupled to clutch shaft 215. Clutch shaft 215 terminates in an end disk 248. Latch 203 has a forked end 249 which receives shaft 215 and abuts against disk 248 to pivotally connect the latch to the clutch shaft. A face cam 213 and a clutch or barrel cam 214 are mounted on shaft 215 between end disk 248 and clutch plate 205. Face cam 213 is fixedly or immovably coupled to housing 240. Shaft 215, adjacent cam 213, is circular in transverse cross-section and is rotatably mounted in a through bore extending axially through cam 213. Shaft 215 is rotatably mounted within cam 213 by bearings 220**.

Face cam 213 has a cam surface extending axially on its front face directed toward clutch plate 205. Cam surface 222 is generally formed in a plane oriented at an acute angle relative to the longitudinal axis of shaft 215.

Clutch cam 214, is mounted on the rectangular cross-sectional portion of shaft 215 such that it cannot rotate relative to shaft 214, but can slide axially along the longitudinal axis of the clutch shaft. Clutch cam has a cam surface 250 which mates and conforms to the cam surface 222 of face cam 213. A compression spring is located between clutch plate 205 and clutch cam 214 to bias clutch cam 214 against face cam 213.

Figure 27:
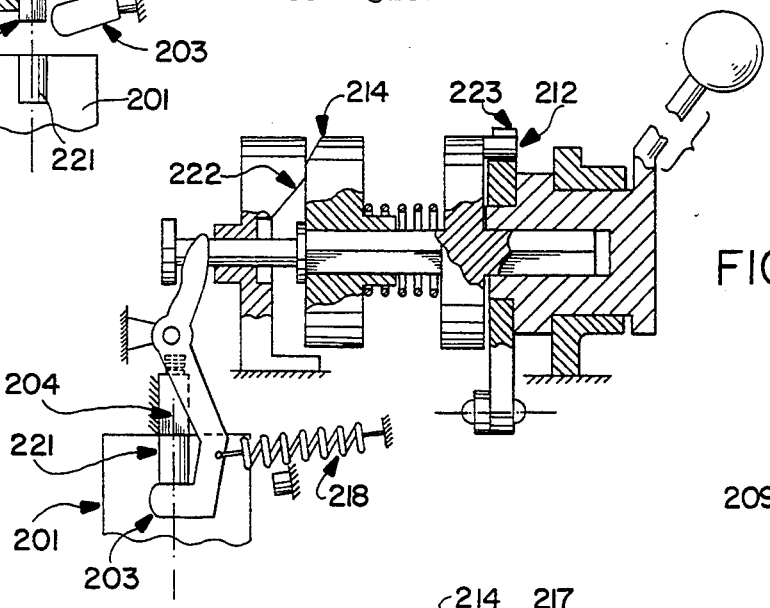
Figure 28:
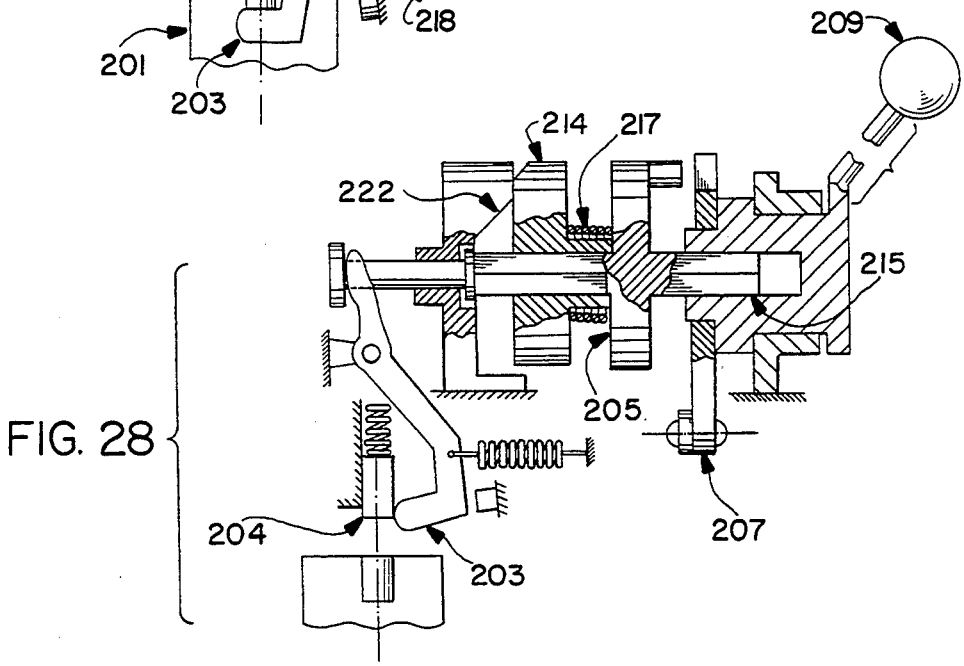

When a plug is not fully inserted within receptacle 202, imposer 204 engages latch 203 to prevent it from pivoting against the bias of return spring 218. With latch 203 fixed or prevented from rotating by engagement with imposer 204 and stop 247, the engagement of forked end 249 with end disk 248 prevents shaft 215 from moving axially relative to actuator plate 207. In this condition, rotation of handle 209 rotates shaft 215 and clutch cam 214 and the engagement and relative movement of cam surfaces 222 and 250 cause clutch cam 214 to move axially relative to the shaft and clutch plate 205, compressing spring 214 as illustrated in FIG. 28. Clutch plate 205, being fixed to clutch shaft 215, is prevented from moving axially to the right, as viewed in FIG. 27, and thereby remains disengaged from actuator plate 207. Although clutch plate 205 remains disengaged from actuator plate 207, the handle can be freely rotated between the off and on positions, without moving the actuator plate and thereby, without activating the switch. With the handle in the on position and released, it will return automatically to the off position under the bias of return spring 219. When the handle returns to the off position, the rotation of the handle and the bias of spring 217 will push clutch cam 214 back to its original position illustrated in FIGS. 25 and 26.

Figure 26:
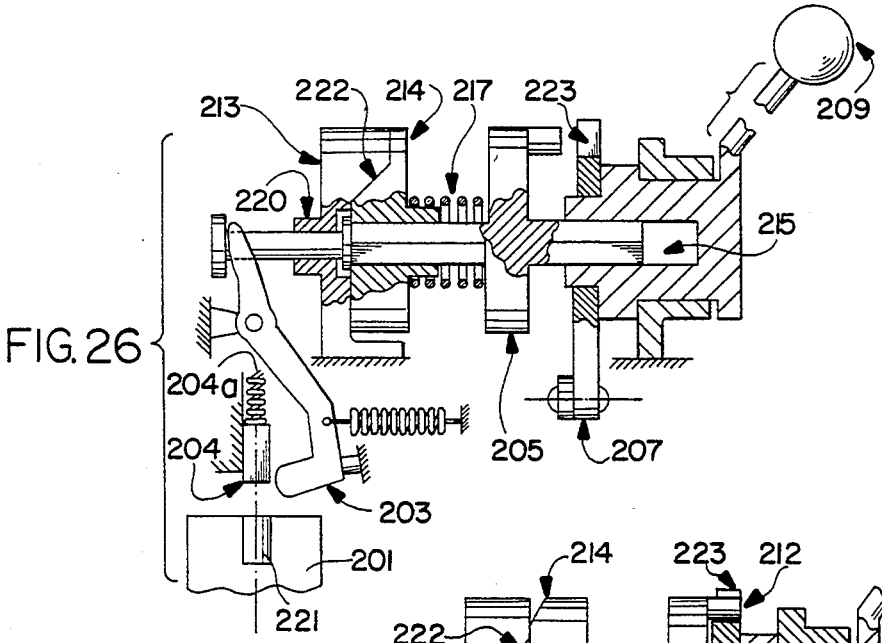
FIGS. 26–28 are side elevational views, partially in section, graphically and diagrammatically illustrating the operation of the switched outlet of FIG. 25 with FIG. 26 illustrating the handle in the off position without a plug in the receptacle, FIG. 27 illustrating the handle in the on position with a plug inserted in the receptacle and FIG. 28 illustrating the handle in the on position without a plug in the receptacle.

From the initial starting position of FIG. 26 with the handle in its off position, a plug can be inserted within the receptacle. Insertion of plug 201 within receptacle 202 pushes imposer 204 upwardly (as illustrated in FIG. 26), against the bias of spring **204*a* out of engagement with latch 203. Key 221 will continue to block rotation of latch 203 until key 221 is also out of the way of latch 203 to insure that the plug is fully inserted within receptacle before the switch can be operated. When the plug is fully inserted, as illustrated in FIG. 27, latch 203 can pivot against the bias of spring 218 to a position in which latch arm 203*b* engages a rear surface of key 221 to lock the plug within the receptacle when the handle is pivoted to the on position. When the handle is moved to the on position, it rotates clutch cam 214 which again rises up on the fixed cam surface 222 of face cam 213**.

Relative rotation of cam 213 and 214 causes cam surfaces 222 and 250 to engage, pushing clutch cam 214 to the right as illustrated in FIG. 27. Since the return spring 218 of the plug latch is substantially weaker than compression spring 217 of the clutch shaft, shaft 215 moves axially to the right with clutch cam 214. As the shaft and the clutch cam start to move axially, latch arm 203b moves behind plug key 221 preventing withdrawal of the plug from the receptacle while the handle is moved from its off position. Continued axial movement of clutch cam 214 as it reaches the top or end of cam surface 222 results in sufficient axial movement of the shaft to bring clutch plate 205 into engagement with actuator plate 207 by projection 212 entering recess 223. Cam geometry is so selected that projection 212 will fill or enter recess 223 before projection face 224 contacts recess end face 223. Continued rotation of handle 209 causes projection face 224 to contact recess end face 225 and transmit rotational movement of the handle to actuator plate 207 and subsequently move switch linkage mechanism 208, 241 and 244 to actuate switch 206.

After the switch has been activated, releasing handle 9 causes it to pivot somewhat under the bias of spring 219 and rotating clutch plate 205 until projection face 226 engages recess end face 227. Since return spring 229 exerts less force than the internal spring force of the switch maintaining the switch in its on position, handle 209 comes to rest at this point. In its final position the plug cannot be removed as noted above.

The switch is returned to its off position as shown in FIG. 26 by rotating handle 209 to the position abutting off-stop 211. As the handle is so rotated, clutch shaft 215 and cam barrel 214 and clutch plate 215 are also rotated. While projection face 226 remains engaged with recess end face 227, the rotation of the handle rotates actuator plate 207 to operate the switch linkage mechanism to move the switch to its off or deactivated position. During the end portion of the rotation of the operating handle to the off position, cam barrel 214 is moved to the left by the reengagement of cam surfaces 222 and 250 and the bias of spring 217. The clutch shaft 215 is also biased to the left as illustrated in FIGS. 26–28 by spring 218 through the engagement of the spring through latch 203 causing the shaft to move to the left. Simultaneously, plug latch 203 rotates to its starting position releasing the plug for removal from electrical receptacle 2 and returning the parts to the initial starting position illustrated in FIG. 26.

The third embodiment of the present invention is diagrammatically and graphically illustrated in FIGS. 29–33. The switched outlet 300 of the second embodiment comprises a housing 340 having an electrical receptacle 302 mounted in one wall of the housing for receiving an electrical plug 301. A switch 313 is mounted in the housing for selective operative by handle 310. A clutch barrel member 307 engages or disengages handle 310 from the mechanism operating switch 313 depending on the position of clutch barrel 307. When clutch barrel 307 is in a first position, handle movement operates switch 313 through the switch actuating mechanism. In the second position of clutch barrel 307, handle 310 is effectively disengaged from the switch actuating mechanism and moves independently of the switch actuating mechanism such that movement of the handle does not operate the switch. The clutch barrel positioning is controlled such that the clutch is in the first position in the handle off position and when plug 301 is received within receptacle 302 during movement of the handle towards the on position, and is placed in the second position when the plug is not fully received within the electrical receptacle during movement of the handle to the on position.

Electrical plug 301 and electrical receptacle 302 are similar to those of the first and second embodiments. A plug nose or key 303 extends radially outwardly at one end of the plug shroud and has a predetermined axial length. A plug locking gear 304 is rotatably mounted in the housing for rotation about an axis defined by an axle 304*a*. A semi-cylindrical, arcuate locking flange extends axially from one face of locking gear 304. Radially extending gear teeth 304*b* extend radially outwardly from an edge of the gear, on a portion of the gear diametrically opposite locking flange 305.

Electrical receptacle 302 includes an axially slidable imposer 306 which is engaged by plug key 303. Imposer 306 is biased forwardly by a spring 306*a*. When the plug is removed from the receptacle, imposer 306 is located in a position to engage an end of locking flange 305 to maintain locking gear 304 in the position illustrated in FIG. 29 and to prevent rotation of locking gear 304. When the plug is inserted, plug key 303 pushes imposer 306 against the bias of spring 306*a* to retract the imposer and to allow locking gear 304 to rotate once the plug is fully inserted within the receptacle. When locking gear 304 rotates, locking flange 304 can engage the rear surface of plug key 303, preventing inadvertent plug removal.

Locking gear 304 is coupled to a return spring 315. Return spring 315 exerts a biasing force on the locking gear tending to rotate the gear in a direction away from imposer 306 from the position illustrated in FIG. 29.

The switch actuating mechanism comprises a switch actuator plate 311 which is rotatably mounted in the housing for rotation independently of and relative to handle 310 when disengaged from clutch barrel 307. Actuator plate 311 is mounted for rotation about the axis of clutch shaft 309, which shaft couples handle 310 to clutch barrel 307. The switch actuating mechanism also comprises a switch link 312 and a switch plate 324. Switch link 312 is pivotally coupled to actuator plate 311 about an axis parallel to the actuator plate rotational axis, but eccentric to the actuator plate rotational axis, by a pivot pin 341 at one end of link 312. The opposite end of the link is pivotally coupled by a sliding pivot assembly 342 to one end of switch plate 324. The opposite end of the switch plate is nonrotatably coupled to actuator shaft 343 of switch 313 to permit simultaneous rotation thereof.

Figures 29, 30:
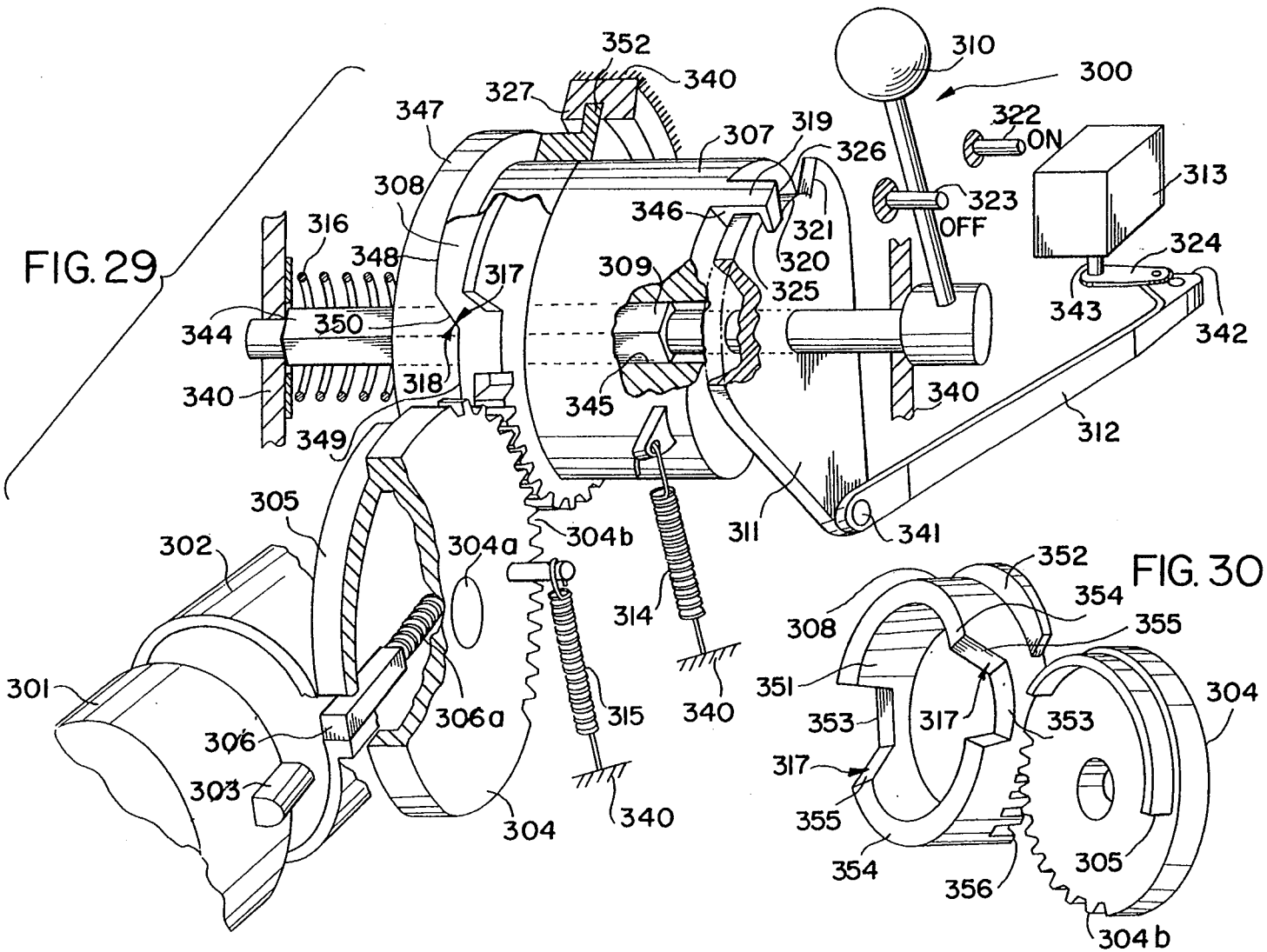
FIG. 29 is a perspective view graphically and diagrammatically illustrating a switched outlet according to a third embodiment of the present invention.
FIG. 30 is a perspective view illustrating portions of the clutch and control mechanism for the switched outlet of FIG. 29.

Rotation of actuator plate 311 in a generally clockwise direction as viewed in FIG. 29 causes link 312 to move longitudinally to the left. Such movement of the link causes rotation of switch plate 324 about the longitudinal axis of switch actuator shaft 343 to move switch 313 to its on position. Rotation of actuator plate 311 in a counter-clockwise direction moves link 312 to the right causing reverse rotation of the switch plate 324 and actuator shaft 343 to deactivate or to turn switch 313 off.

Actuator plate 311 comprises an arcuate recess 320 defined between end faces 321 and 325. The arc of recess 320 has a center of curvature on the axis of rotation of actuator plate 311 such that the recess arc is spaced from or eccentric to the actuator plate axis of rotation. End faces 221 and 225 define the width of the recess between them.

Movement of handle 310 relative to the housing is limited by on-stop 322 and off-stop 323. Handle 310 is mounted in an opening in the wall of housing 340 to permit it to pivot between its on and off positions about the longitudinal axis of clutch shaft 309. Handle 310 and shaft 309 are fixed to prevent relative rotation therebetween and to insure simultaneous rotation thereof.

Clutch barrel 307 is mounted on shaft 309 such that it must rotate with the shaft, but can slide axially on the shaft. This connection between the shaft and the clutch barrel is provided by a clutch shaft portion 344 and a clutch barrel bore 345 having mating noncircular transverse cross-sectional configurations. Such configurations can be, for example, rectangular.

Clutch shaft 309 is rotatably mounted in housing 340 adjacent to the opposite ends. Clutch barrel 307 is located between the opposite, rotatably mounted ends of the clutch shaft.

A projection 319 extends axially from one face of the clutch barrel adjacent actuator plate 311. Projection 319 is spaced radially from the rotational axis of clutch barrel 307 and extends in a direction toward actuator plate 311 and parallel to the axis of clutch shaft 309. The lateral sides of projection 319 are defined by projection faces 326 and 346. The spacing between projection faces 326 and 346 is substantially less than the spacing between recess end faces 321 and 325.

Clutch barrel 307 is normally engaged with actuator plate 311 by projection 319 being located within recess 320, similar to the first embodiment. Engagement of projection 319 and recess 320 engages actuator plate 311 to transmit the rotation of handle 310 to switch actuator plate 311 such that movement of the handle activates or deactivates the switch. Movement of the actuator plate to activate the switch occurs when projection face 326 engages recess end face 321, when the handle is moved from the off position to the on position. Movement of the handle from the on position to the off position rotates actuator plate 311 when projection face 346 engages recess end face 325.

Projection 319 is removed from recess 320 when the clutch barrel disengages handle 310 from actuator plate 311. This disengagement of the handle from the switch actuator plate 311 occurs when the handle is operated without a plug 301 fully inserted within electrical receptacle 302.

Clutch barrel 307 is engaged by a return spring 314 exerting a biasing force to the clutch barrel in a rotational direction toward engagement of projection face 346 against recess end face 325. This biasing force also biases handle 310 towards its off position. Clutch barrel 307 comprises cam 318 on its end remote from projection 319, but facing generally in the same axial direction as projection 319. Cam 318 is formed on a flange 347 which extends radially outwardly at an axial end clutch barrel 307 remote from actuator plate 311.

Cam 318 is formed on the generally annular, radially extending, but axially facing, surface of flange 347. Cam 318 comprises two surfaces 348 and 349 which are perpendicular to the rotational axis of the clutch barrel and axially spaced along that rotational axis. Cam surfaces 348 and 349 are joined by a ramp surface 350.

A spring 316 is mounted about shaft 309 between housing 340 and clutch barrel 307. This spring biases clutch barrel 307 in a axial direction toward and into engagement with actuator plate 311.

A cam or clutch gear 308 couples clutch barrel 307 to latch gear 304 to control the position of the clutch barrel dependent upon the presence or absence of a plug in electrical receptacle 302. Cam gear 308 has an axially extending through bore 351 through which clutch barrel 307 extends. The cam gear surrounds an outer axial portion of the clutch barrel between flange 347 and projection 319 and is adjacent flange 347. A flange 352 extends radially outwardly from a generally semi-circular portion adjacent one axial end of cam gear 38. Flange 352 is received within a thrust bearing 327. Engagement of flange 352 and thrust bearing 357 permits the cam gear to rotate about its longitudinal axis within housing 340, but restrains the cam gear from moving in an axial direction relative to its rotational axis.

A cam 317 is formed in an axial end of cam gear 308 facing clutch barrel flange 347. Cam 317 comprises cam surfaces 353 and 354 which are transverse to the rotational axis of the cam gear. Cam surfaces 353 and 354 are connected by an angled surface 355. Cam surfaces 353 and 354 are axially spaced along the rotational axis of cam gear 308.

Cam surfaces 348 and 353 and cam surfaces 349 and 354 are in surface to surface contact when clutch barrel 307 engages actuator plate 311. If the clutch barrel 307 is rotated relative to cam gear 308, surfaces 350 and angled surfaces 355 slide on one another forcing and moving clutch barrel 307 in an axial direction away from actuator plate 311 and against bias of spring 316 to completely disengage the clutch barrel from the actuator plate when cam surface 349 engages cam surfaces 354 (FIG. 32).

Cam gear 308 has radially extending gear teeth 356. Gear teeth 356 are located on a semi-cylindrical outer surface portion of the cam gear diametrically opposite flange 352. Gear teeth 356 are configured and located to engage gear teeth **304*b* of locking gear 304**.

From the initial starting position illustrated in FIGS. 29 and 31, a plug can be inserted within the receptacle. Without plug 301 inserted fully within receptacle 302, locking gear 304 and cam gear 308 cannot rotate due to the engagement of locking flange 305 with imposer 306 and the engagement of gear teeth **304*b* and 356. In this position, when handle 310 is rotated to its on position, clutch barrel 307 is similarly rotated through its connection with clutch shaft 309. The rotation of clutch barrel 307 relative to the stationarily held cam gear 308 causes relative movement and engagement of cams 317 and 318 causing ramp surface 350 to slide along angled surface 355. Sliding engagement of the ramp and angled surfaces causes clutch barrel 307 to move in an axial direction away from switch actuator plate 311 to remove projection 319 from its normal position within recess 320. Removal of the projection from the recess prevents rotation of the handle from being transmitted to the actuator plate 311, and thereby preventing activation of switch 313. Upon release of handle 310, the handle will return under the bias of return spring 314 to its off position, and reposition the clutch barrel to its initial starting position relative to shaft 309 and cam gear 308. The axial movement of the clutch barrel in which the clutch disengages the handle from actuator plate 311** is illustrated in FIG. 32.

The cam geometry is such that projection 319 is completely removed from recess 320 before projection face 326 engages recess end face 321. The larger width of the recess 320 relative to projection 319 is provided to enable the clutch barrel to rotate to a sufficient degree for it to move axially and be withdrawn from the recess before engagement of faces 326 and 321.

The movement of the switched outlet 300 to the on position with plug 301 fully inserted within electrical receptacle 302 is illustrated in FIG. 33. When plug 31 is inserted in receptacle 302, plug key 303 pushes imposer 306 backward against the bias of spring 306 to remove the imposer from engagement with locking flange 305 of locking gear 304, permitting locking gear 304 to rotate against the bias of spring 315. Subsequent rotation of handle 310 causes clutch barrel 307 to rotate simultaneously along with shaft 309 and simultaneously with cam gear 308. Return spring 315 coupled to locking gear 304 exerts a substantially lower resistive torque at the interface of cams 317 and 318 then is provided by the driving torque of clutch barrel 307. In other words, the force required to cause the clutch barrel to move axially relative to the cam gear 308 and against the bias of spring 316 is substantially greater than the forces generated by spring 315. These relative forces cause cam gear 308 to rotate simultaneously with clutch 307. Rotation of cam gear 308 causes locking gear 304 to rotate because of the engagement of the gear teeth **304*b* and 356. As the locking gear rotates, locking flange 305 moves behind the rear surface of plug key 303 to lock plug 301 in receptacle 302. This prevents withdrawal of the plug while the handle and switch are located in the on position. As the clutch barrel 307 is rotated by the handle movement towards the on-stop 322, projection 319 engages recess end face 21 of actuator plate 311. Upon engagement of projection surface 326 with recess end face 321, handle motion is transmitted to actuator plate 311 causing the actuator plate to rotate, link 312 to move longitudinally, and switch plate 324 to rotate, thereby causing rotation of switch shaft 343 and activation of switch 313. Motion of handle 310 is stopped by its engagement with on-stop 322. By the time handle 310 engages on-stop 322, switch 313** would have been rotated to its on position and held in the on position by an internal over the center spring thereof.

When the handle is released, clutch barrel is rotated in the opposite direction under the bias spring 314 until projection 319 engages recess end face 325. The clutch barrel remains in this position because the biasing force exerted by return spring 314 is substantially weaker than the over centered spring of switch 313.

To deactivate the switch, the handle is moved from the on position toward off-stop 323. This rotation transmits a rotating force from the handle to clutch barrel 307 and then to actuator plate 311 by engagement of projection 319 against recess end surface 325. Rotation of handle 10 thus moves actuator plate 311, switch link 312 and switch plate 324 to rotate switch actuator shaft 343, and thereby turn switch 313 to its off position. During this rotation of clutch barrel 307, cam gear 308 will rotate with the clutch barrel causing rotation of locking gear 304 back to its original or starting position. Once locking gear 304 is back in its original position, locking flange 305 is removed from blocking the path of plug key 303 such that the plug can now be removed from the electrical receptacle 302 now that the switch has again been deactivated.

While various embodiments have chosen to illustrate the invention, it will be understood by those skilled in the art that various changes and modifications can be made therein without departing from the scope of the invention as defined in the appended claims.

What is claimed is:

1. A switched outlet presenting a dead front, comprising:

a housing;

an electrical receptacle mounted in said housing for receiving an electrical plug;

a switch mounted in said housing, an operating handle coupled to said housing and movable between on and off positions;

switch actuating means, coupled to said switch, for activating and deactivating said switch;

clutch means, mounted in said housing, for engaging said handle and said switch actuating means in a first position of said clutch means such that movement of said handle from said off position to said on position activates said switch through said switch actuating means and for disengaging said handle and said switch actuating means in a second position of said clutch means such that movement of said handle from said off position to said on position does not operate said switch; and control means, coupled to said clutch means and said electrical receptacle, for placing said clutch means in said first position when an electrical plug is fully received in said electrical receptacle and for placing said clutch means in said second position when no electrical plug is fully received in said electrical receptacle, during movement of said handle from said off position to said on position.

2. A switched outlet according to claim 1 wherein said clutch means comprises a clutch member axially movable between said first and second positions and having an axially extending first engagement means; and said switch actuating means comprises a pivotable actuator plate having an axially extending second engagement means releasably engaged with said first engagement means in said first position and spaced from said first engagement means in said second position.

3. A switched outlet according to claim 2 wherein said clutch member is coupled to said handle by a shaft for simultaneous rotation of said handle, said shaft and said clutch member; and said actuator plate is rotatable relative to said shaft when said first and second engagement means are spaced, but is rotatable with said clutch member when said first and second engagement means are engaged.

4. A switched outlet according to claim 3 wherein a spring biases said clutch member axially toward said first position.

5. A switched outlet according to claim 3 wherein said handle is spring biased toward said off position.

6. A switched outlet according to claim 2 wherein said first engagement means comprises a projection; and said second engagement means comprises a recess receiving said projection.

7. A switched outlet according to claim 3 wherein said first and second engagement means extend along first and second arcs, respectively, said second arc being greater than said first arc.

8. A switched outlet according to claim 3 wherein said switch actuating means comprises an elongated link having a first end thereof eccentrically coupled to said actuator plate and a second end thereof connected to said switch, such that rotation of said actuator plate axially moves said elongated link.

9. A switched outlet according to claim 8 wherein said switch comprises a rotatable switch shaft extending therefrom, rotation of said switch shaft changing said switch between on and off conditions; and said switch actuating means comprises a switch plate extending transversely from and attached to said switch shaft for simultaneous rotation therewith, said switch plate being coupled to said second end of said elongated link.

10. A switch outlet according to claim 9 wherein said elongated link is coupled to said actuator plate and said switch plate by first and second sets of mating gear teeth, respectively.

11. A switched outlet according to claim 3 wherein said clutch member comprises a generally cylindrical body having a first cam track extending circumferentially on an outer surface of said cylindrical body, said first cam track having first and second cam surfaces axially spaced on said cylindrical body and connected by a ramp surface; and said control means comprises a cam follower engaged in said first cam track and coupled to latch means for locking said cam follower in a fixed position when no electrical plug is received in said electrical receptacle to cause said clutch member to move to said second position as said clutch member is rotated by said handle with engagement of said cam follower on said first cam surface locating said clutch member in said first position, with engagement of said cam follower on said second cam surface locating said clutch member in said second position and with engagement of said cam follower on said ramp surface locating said clutch member between said first and second positions.

12. A switched outlet according to claim 11 wherein said latch means comprises a pivotally mounted latch member coupled to a spring biasing cam follower against said first cam track; and said control means further comprises a spring biased imposer releasably engaging said latch member and retaining said cam follower in said fixed position.

13. A switched outlet according to claim 12 wherein said imposer is slidably mounted in a recess in a latch cover and extends into said electrical receptacle to engage the electrical plug such that the electrical plug moves said imposer to a position allowing said latch member to pivot.

14. A switched outlet according to claim 11 wherein said cylindrical body of said clutch member comprises a second cam track extending circumferentially on said outer surface of said cylindrical body spaced from said first cam track, said second cam track having third and fourth cam surfaces axially spaced on said cylindrical body and an angled cam surface;

a second cam follower is mounted on a pivoted lever, said second cam follower being movable between a closed position in which said second cam follower is spaced from said second cam track and an open closed position in which said second cam follower is engaged in said second cam track as said clutch member rotates, engagement of said second cam follower on said third cam surface locating said clutch member in said first position, engagement of said second cam follower on said fourth cam surface locating said clutch member in said second position, engagement of said second cam follower on said angled surface locating said clutch member between said first and second positions;

spring means biases said second cam follower toward said open position; and a door is coupled to said housing and has a projection for engaging said lever and moving said cam follower to said closed position when said door is closed.

15. A switched outlet according to claim 2 wherein said actuator plate comprises a first locking means extending therefrom; and a door is removably coupled to said housing and comprises a second locking means extend therefrom, said first and second locking means engaging and locking said door in a closed position when said actuator plate is pivoted to turn said switch on.

16. A switched outlet according to claim 15 wherein said first locking means comprises an integral flange extending transversely from said actuator plate; and said second locking means comprises a catch mounted on an inner surface of said door.

17. A switched outlet according to claim 2 wherein said clutch member comprises a generally cylindrical, rotatable body including a cam track extending circumferentially on said outer surface of said cylindrical body, said cam track having first and second cam surfaces axially spaced on said cylindrical body and an angled cam surface;

a cam follower is mounted on a pivoted lever, said second cam follower being movable between a closed position in which said cam follower is spaced from said cam track and an open closed position in which said cam follower is engaged in said cam track as said clutch member rotates, engagement of said cam follower on said first cam surface locating said clutch member in said first position, engagement of said second cam follower on said second cam surface locating said clutch member in said second position, engagement of said second cam follower on said angled surface locating said clutch member between said first and second positions;

spring means biases said cam follower toward said open position; and a door is coupled to said housing and has a projection for engaging said lever and moving said cam follower to said closed position when said door is closed.

18. A switched outlet according to claim 3 wherein said clutch member is fixedly attached to said shaft to prevent relative axial movement of said clutch member and said shaft;

said control means is coupled to said shaft to restrain retain said clutch member in said second position when no electrical plug in said electrical receptacle and to permit said clutch member to move to said first position when the electrical plug is inserted in said electrical receptacle.

19. A switched outlet according to claim 18 wherein said control means comprises a pivotally mounted latch member coupled to said shaft and a spring biasing said latch member in a direction toward locating said clutch member in said second position; and said control means further comprises a spring biased imposer releasably engaging said latch member and retaining said latch member in a position preventing axial movement of said shaft and of said clutch member toward said first position.

20. A switched outlet according to claim 19 wherein said control means comprises a face cam fixedly mounted in said housing and a clutch cam non-rotatably mounted on said shaft, said face cam and said clutch cam having mating cam surface means for moving said clutch member into said first position when said clutch cam is rotated relative to said face cam and when said imposer is disengaged from said latch member.

21. A switched outlet according to claim 20 wherein a compression spring is located between clutch member and said clutch cam.

22. A switched outlet according to claim 3 wherein said clutch member comprises a generally cylindrical body having a first cam track extending circumferentially on an outer surface of said cylindrical body, said first cam track having first and second cam surfaces axially spaced on said cylindrical body and connected by a ramp surface; and said control means comprises an axially fixed rotatable cam gear engaged with said first cam track and coupled to latch means for locking said cam gear in a fixed rotational position when no electrical plug is received in said electrical receptacle to cause said clutch member to move from said first position to said second position as said clutch member is rotated by said handle from said off position to said on position.

23. A switched outlet according to claim 22 wherein said latch means comprises a rotatably mounted latch gear; and said control means further comprises a spring biased imposer releasably engaging said latch gear and restraining said cam gear from rotation.

24. A switched outlet according to claim 23 wherein said latch gear comprises partially cylindrical locking flange for engaging a plug key.

25. A switched outlet according to claim 22 wherein a spring biases said clutch member axially toward said first position.

26. A switched outlet according to claim 1 wherein said clutch means comprises a clutch member movable between said first and second positions and having a first engagement means; and said switch actuating means comprises second engagement means releasably engaged with said first engagement means in said first position and spaced from said first engagement means in said second position.

27. A switched outlet according to claim 1 wherein said clutch means comprises a clutch member movable between said first and second positions and having a first engagement means; and one of said handle and said switch actuating means comprises second engagement means releasably engaged with said first engagement means in said first position and spaced from said first engagement means in said second position.

* * * * *